US006057502A

United States Patent [19]

Fujishima

[11] Patent Number: 6,057,502

[45] Date of Patent: May 2, 2000

[54] APPARATUS AND METHOD FOR RECOGNIZING MUSICAL CHORDS

[75] Inventor: Takuya Fujishima, Hamamatsu, Japan

[73] Assignee: Yamaha Corporation, Hamamatsu, Japan

[21] Appl. No.: 09/281,526

[22] Filed: Mar. 30, 1999

[51] Int. Cl.[7] ..... G10H 1/38

[52] U.S. Cl. ..... 84/637; 84/616

[58] Field of Search ..... 84/616, 637, 654, 84/669

[56] References Cited

U.S. PATENT DOCUMENTS

| | | | |
|---|---|---|---|
| 5,202,528 | 4/1993 | Iwaooji | 84/616 |
| 5,440,756 | 8/1995 | Larson | 84/637 X |
| 5,760,326 | 6/1998 | Ishibashi | 84/626 |
| 5,952,597 | 9/1999 | Weinstock et al. | 84/609 |

OTHER PUBLICATIONS

Richard Parncutt, "Harmony: A Psychoacoustical approach", Springer–Verlag, ML 3836 P256, 1989.

Chris Chafe, et al., "Techniques for Note Identification in Polyphonic Music", STAN–M–29, CCRMA, Stanford University, Oct. 1985.

Chris Chafe, et al., Source Separation and Note Identification in Polyphonic Music, STAN–M–34, CCRMA, Stanford University, Apr. 1986.

Kunio Kashino, et al., "Application of Bayesian Probability Network to Music Scene Analysis", IJCAI Proceedings, 1995.

Marc Leman, "Auditory Models of Pitch Perception", Music and Schema Theory, Springer–Verlag.

Curtis Roads, "The Computer Music Tutorial" MIT Press.

Michele Biasutti, "Sharp Low– and High–Frequency Limits on Musical Chord Recognition", Hearing Research, No. 105, pp. 77–84, 1997.

Haruhiro Katayose, et al., "The Kansei Music System", Computer Music Journal, vol. 13, No. 4, pp. 72–77, 1989.

Richard Parncutt, "Revision of Terhardt's Psychoacoustical Model of the Root(s) of a Musical Chord", Music Perception, Vo. 6, No. 1, pp. 65–94, 1988.

Richard Parncutt, "Template–Matching Models of Musical Pitch and Rhythm Perception", Journal of New Music Research, vol. 23, pp. 145–167, 1994.

*Primary Examiner*—Jeffrey Donels

*Attorney, Agent, or Firm*—Graham & James LLP

[57] ABSTRACT

A time fraction or short duration of a musical sound wave is first analyzed by the FFT processing into frequency components in the form of a frequency spectrum having a number of peak energy levels, a predetermined frequency range (e.g. 63.5–2032 Hz) of the spectrum is cut out for the analysis of chord recognition, the cut-out frequency spectrum is then folded on an octave span basis to enhance spectrum peaks within a musical octave span, the frequency axis is adjusted by an amount of difference between the reference tone pitch as defined by the peak frequency positions of the analyzed spectrum and the reference tone pitch used in the processing system, and then a chord is determined from the locations of those peaks in the established octave spectrum by pattern comparison with the reference frequency component patterns of the respective chord types. Thus, the musical chords included in a musical performance are recognized from the sound wave of the musical performance. Autocorrelation method may preferably be utilized to take the autocorrelation among the frequency components in the octave profile on the basic unit of a semitone span in order to enhance the peaks in the frequency spectrum of the octave profile on a semitone basis.

14 Claims, 15 Drawing Sheets

HARDWARE STRUCTURE

DIVIDING SOUND WAVEFORM INTO TIME SLICES

DIVIDING SOUND WAVEFORM INTO TIME SLICES

FREQUENCY FOLD PROCESSING

FREQUENCY FOLD PROCESSING

PEAK ENHANCEMENT PROCESSING (1)

PEAK ENHANCEMENT PROCESSING (2)

PEAK ENHANCEMENT PROCESSING (3)

CRUDE OCTAVE PROFILE P0
AUTOCORRELATION PROCESSING
P 1
P 2
P 3
P 11
SHIFTED OCTAVE PROFILE Pn
P' 1
P' 2
P' 3
P' 11
AUTOCORRELATED PROFILE P'n
BETWEEN P0 AND Pn
ENHANCED OCTAVE
PROFILE Q

ENHANCED OCTAVE PROFILE Q

DIVIDE INTO TWELVE EQUAL PARTS OF SEMITONE SPAN AND SUM THEM UP IN SEMITONE SPAN

SUMMED-UP PROFILE MAKES SEMITONE PROFILE S0

SEMITONE PROFILE S0

CIRCULARLY SHIFT RING SEMITONE PROFILE S0 BY PREDETERMINED AMOUNTS TO CALCULATE RESPECTIVE PAIRS OF VARIANCE AND MEAN

PROFILE PF

WEIGHTING PATTERN

RESULT OF INNER PRODUCT
(WHERE DEGREE OF COINCIDENCE IS HIGH)

APPARATUS AND METHOD FOR RECOGNIZING MUSICAL CHORDS

BACKGROUND OF THE INVENTION

1. Field of the Invention

The present invention relates to an apparatus and a method for recognizing musical chords from incoming musical sound waveform, and more particularly to such an apparatus and a method in which a fractional duration of sound wave is analyzed into a frequency spectrum having a number of level peaks and exhibiting a spectrum pattern, and then a chord is recognized based on the locations of those peaks in the spectrum pattern.

2. Description of the Prior Art

The prior art for recognizing chords by analyzing musical sound waves includes Marc Leman's approach which contemplates the derivation of information necessary for establishing a chord directly from the information of a frequency spectrum (the distribution of energy levels of respective frequency components) of a musical sound waveform subjected to analysis from a conceptual point of view that each chord is a pattern constituted by a combination of plural frequency components. As a practical example of such a chord recognition method, there has been proposed a process utilizing a simple auditory model (usually referred to as "SAM") including process steps as shown in FIG. 16.

Referring to FIG. 16, the chord recognition process steps of the SAM method will be descried briefly hereunder. The SAM method is to recognize chords by reading out wave sample data of one fraction (along the time axis) after another of the stored (in the storage device of the analyzing system beforehand) sound waveform of a musical tune (performance) from the top of the wave, and recognizing each chord for each time fraction of the sound waveform. For example, step A reads out data of a fractional piece of the musical sound wave (e.g. of an amount for the time length of 400 milliseconds or so) from among the stored sound wave sample data as a subject of the analysis, and step B extracts the frequency components of the read-out fraction of the sound wave using the FFT (Fast Fourier Transform) analysis to establish a frequency spectrum of the wave fraction. Then, step C folds (cuts and superposes) the frequency spectrum of the extracted frequency components throughout the entire frequency range on an octave span basis to create a superposed (combined) frequency spectrum over the frequency width of one octave, i.e. an octavally folded frequency spectrum, and locates several peaks exhibiting prominent energy levels in the octaval spectrum, thereby nominating peak frequency components. Step D then determines the tone pitches (chord constituting notes) corresponding to the respective peak frequency components and infers the chord (the root note and the type) based on the peak frequencies (i.e. the frequencies at which the spectrum exhibits peaks in energy level) and the intervals between those peak frequencies utilizing a neural network.

The SAM method, however, has some drawbacks as mentioned below.

(1) As all of the frequency components that are extracted by the FFT process are used for the recognition of a chord, there are so many frequency components to be analyzed that the amount of computation in each of the analyzing processes for recognizing a chord is accordingly large. And moreover, as the frequency components in such a low and a high frequency range that is not audible to human ear are also involved in the analysis, the accuracy of analysis will be deteriorated.

(2) While a number of frequency components that exhibit large energy levels are simply determined to be the peak frequency components, such determination of peak frequency components may not be very adequate, considering the fact that there may be included a fairly large noise frequency components in the frequency components that are extracted from the sound wave data. For example, if a peak frequency component is determined within the frequency range which includes frequency components with like energy levels, there can be a high possibility of inadequate determination of the peak frequency component, which will lead to an erroneous recognition of the chord.

(3) In inferring note pitches from the peak frequency components, the note pitches are determined simply taking the frequency component of 440 Hz as the A4 note reference. Therefore, in the case where the pitches of all the tones in the musical tune to be analyzed are deviated as a whole (i.e. shifted in parallel), the note pitches will be erroneously inferred. Another disadvantage will be that an overall pitch deviation may cause one peak area to fall in two adjacent frequency zones and extract two peak frequency components from one actually existing tone in those zones, and thus the inference will be that there are two notes sounded even though there is actually only one tone sounded in such a frequency zone.

(4) Marc Leman's paper simply describes that the determination of the chord is made by using a neural network. And accordingly, what kind of process is actually taken for determining the chord type is not clear, and moreover the behavior of the neural network cannot be controlled indicatively by a human, which leads to an insufficient reliability for practical use.

SUMMARY OF THE INVENTION

It is, therefore, a primary object of the present invention to overcome the drawbacks involved in the prior art apparatuses and methods and to provide a musical chord recognizing apparatus and method capable of recognizing chords directly from musical sound wave data accurately and quickly.

According to the present invention, a time fraction (short duration) of a musical sound wave is fist analyzed into frequency components in the form of a frequency spectrum having a number of peak energy levels, a predetermined frequency range of the spectrum is cut out for the analysis of chord recognition, the cut-out frequency spectrum is then folded on an octave span basis to enhance spectrum peaks within a musical octave span, the frequency axis is adjusted by an amount of difference between the peak frequency positions of the analyzed spectrum and the corresponding frequency positions of the processing system, and then a chord is determined from the locations of those peaks in the established octave spectrum by pattern comparison with the reference frequency component patterns of the respective cord types.

According to one aspect of the present invention, the object is accomplished by providing a musical chord recognizing apparatus which comprises a frequency component extracting device which extracts frequency components from incoming musical sound wave data, a frequency range cutting out device which cuts out frequency component data included in a predetermined frequency range from the extracted frequency component data, an octave profile creating device which folds and superpose the cut-out frequency component data on the basis of the frequency width of an octave span to create an octave profile of the musical sound wave, a pitch adjusting device which detects the deviation (difference) of the reference pitch of the incoming musical sound wave from that of the signal processing system in the chord recognizing apparatus and shifts the frequency axis of the octave profile by the amount of such a deviation (difference), a reference chord profile providing device which provides reference chord profiles respectively exhibiting patterns of existing frequency components at the frequency zones each of a semitone span corresponding to the chord constituent tones for the respective chord types, and a chord determining device which compares the pitch-adjusted octave profile with the reference chord profiles thereby determining the chord established by the incoming sound wave.

According to another aspect of the present invention, the object is accomplished by providing a musical chord recognizing apparatus which further comprises an autocorrelation device which takes the autocorrelation among the frequency components in the octave profile on the basic unit of a semitone span in order to enhance the peak contour of the octave profile on a semitone basis.

According to a further aspect of the present invention, the object is accomplished by providing a musical chord recognizing apparatus in which the pitch adjusting device for adjusting the octave profile along the frequency axis comprises a semitone profile creating device which folds and superposes the octave profile on a semitone span basis to create a semitone profile exhibiting a folded frequency spectrum over a semitone span, a semitone profile ring-shifting device which ring-shifts the semitone profile by a predetermined pitch amount successively (one shift after another shift) to calculate a variance at each shift, a deviation detecting device which detects the deviation amount of the reference pitch of the profile from the reference pitch of the apparatus system based on the shift amount that gives the minimum variance value among the calculated variances for the respective shifts, and a pitch shifting device which shifts the octave profile by the amount of the detected deviation toward the reference pitch of the apparatus system, whereby the peak positions in the frequency axis are easily and accurately located and thus the chord will be correctly recognized.

According to a still further aspect of the present invention, the object is accomplished by providing a musical chord recognizing apparatus in which the reference chord profile providing device provides each of the reference chord profiles in the form of weighting values for the respective frequency components existing in the frequency zones each of a semitone span, in which the chord determining device multiplies the intensities (energy levels) of the frequency components in the pitch-adjusted octave profile in each semitone span and the weighting values in each semitone span, the multiplication being conducted between each corresponding pair of frequency components in the respective semitone spans, and sums up the multiplication results to recognize the chord of the subjected time fraction of sound wave.

According to one feature of the present invention, the frequency components to be used for chord recognition are only those that belong to such a predetermined frequency range that includes those frequencies which are considered to be used in recognizing chords by human ear and that are cut out from the whole frequency components extracted from the subject sound wave for analysis. Thus, the data which are unnecessary for chord recognition are excluded from the subjects of analysis, and the amount of calculation for the chord recognition is accordingly decreased so that the data processing can be conducted quickly and the accuracy of analysis can be increased. An example of the frequency range to be cut out is 63.5 through 2032 Hz.

According to a further feature of the present invention, the overall pitch deviation of the musical tune to be analyzed from the system reference pitch is obtained and is utilized in recognizing a chord. This will permit a correct recognition of a chord even where the pitches of an actual musical tune to be analyzed are deviated from the system reference pitch (usually, the note pitches are determined taking the note of A4 as being 440 Hz). Further the chances of a peak exhibiting frequency component erroneously falling in two adjacent pitch zones will be eliminated.

According to a still further feature of the present invention, making use of the fact that the frequency differences between any chord constituent tones are integer multiples of a semitone width, the created frequency spectrum of one octave span is multiplied with the same spectrum which is ring shifted by an amount of n semitones, where n are successively 1 through 11, and eleven multiplication products are added together to enhance the peaks of the frequency components (spectrum) necessary for the chord recognition to be more prominent than the noise frequency components (this process is hereinafter referred to as a "autocorrelation process"). The peaks can thus be located easily and accurately, which greatly contributes to correct recognition of the chords.

According to the invention, the recognition of a chord is performed by comparing the plural located peak exhibiting frequency components with the respective chord constituting note patterns which are provided in the system (apparatus) beforehand and calculating the degree of (agreement) coincidence. This clarifies the process of recognizing chords from the located spectrum peaks and makes the process practical, and further the peak positions of each chord for comparison is artificially controllable so that the degree of accuracy in chord recognition is also controllable.

BRIEF DESCRIPTION OF THE DRAWINGS

For a better understanding of the present invention, and to show how the same may be practiced and will work, reference will now be made, by way of example, to the accompanying drawings, in which.

DESCRIPTION OF THE PREFERRED EMBODIMENTS

Figure 1:
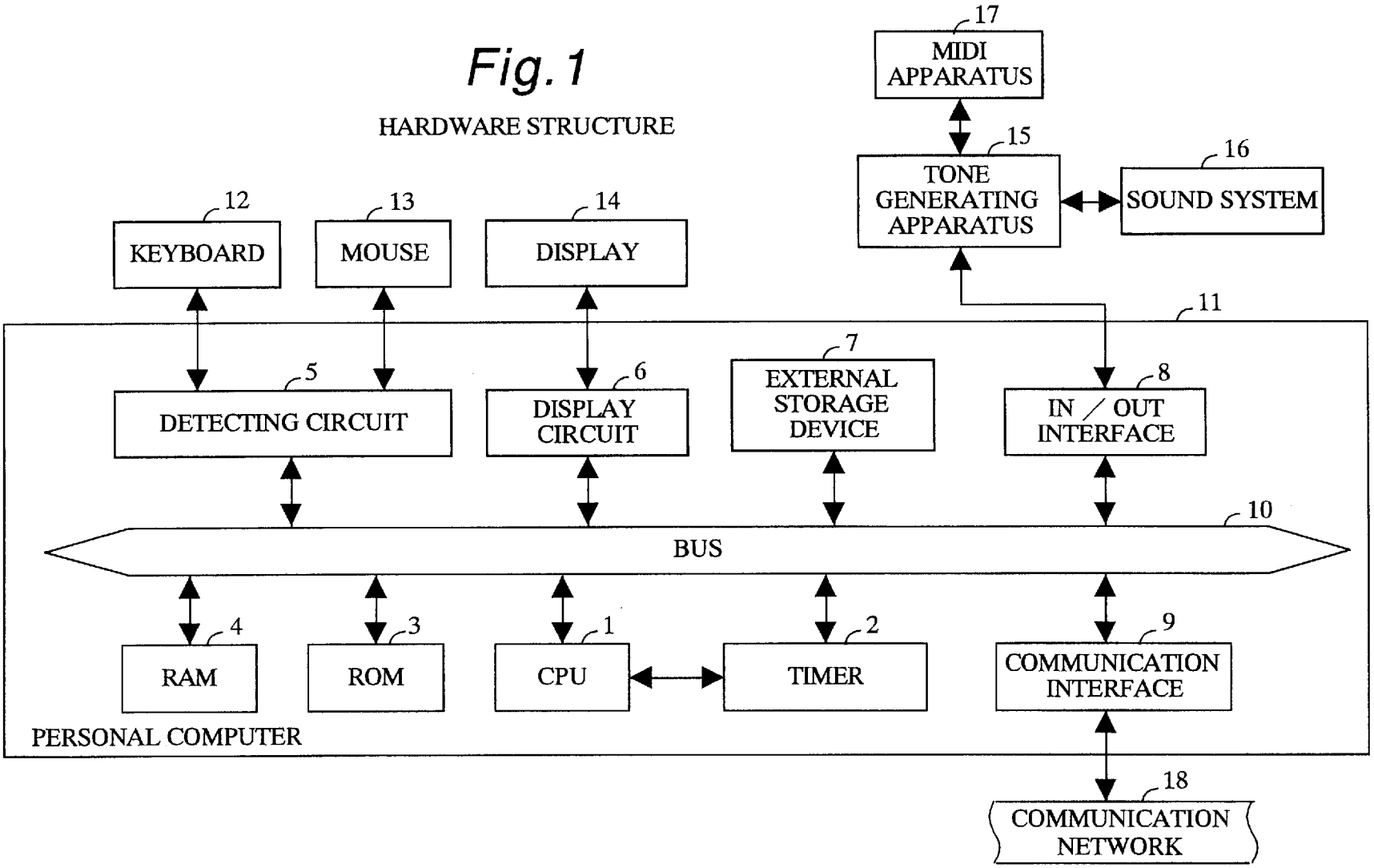
FIG. 1 is a block diagram showing an outline of a hardware structure of an embodiment of a chord recognizing apparatus of the present invention.

Illustrated in FIG. 1 of the drawings is a general block diagram showing an outline of a hardware structure of an embodiment of a chord recognizing apparatus of the present invention. The system of this embodiment comprises a central processing unit (CPU) 1, a timer 2, a read only memory (ROM) 3, a random access memory (RAM) 4, a detecting circuit 5, a display circuit 6, an external storage device 7, an in/out interface 8 and a communication interface 9, which are all connected with each other via a bus 10. All these elements may thus be structured by a personal computer 11.

The CPU 1 for controlling the entire system of the apparatus is associated with the timer 2 generating a tempo clock signal to be used for the interrupt operations in the system, and performs various controls according to the given programs, especially administrating the execution of the chord recognizing processing as will be described later. The ROM 3 stores control programs for controlling the system, including various processing programs for the chord recognition according to the present invention, various tables such as weighting patterns and various other data as well as the basic program for the musical performance processing on the apparatus. The RAM 4 stores the data and parameters necessary for various processing, and is used as work areas for temporarily stores various registers, flags, data under processing, also providing storage areas for various files used in the process of chord recognition according to the present invention such as a file of sampled waveform data, a frequency spectrum file and an octave profile file. The contents of those files will be described hereinafter.

To the detecting circuit 5 are connected manipulating devices such as a keyboard 12 and a mouse 13, to the display circuit 6 is connected a display 14, and to the in/out interface 8 is connected a tone generating apparatus 15 so that the musical performance data from the personal computer 11 is converted into tone signals to be emitted as audible musical sounds via a sound system 16. The tone generating apparatus 15 may be constructed by software and a data processor. To the tone generating apparatus are also connected MIDI (musical instrument digital interface) apparatuses 17 so that performance data (in the MIDI format) may be converted into tone signals to be emitted as audible musical sounds via the sound system 16. The MIDI apparatuses can also transmit and receive the musical performance data to and from the computer system 11 according to the present invention via the in/out interface 8, passing through the tone generating apparatus 15.

Utilizing External Storage Device

A hard disk drive (HDD), a compact disk read only memory (CD-ROM) drive, and other storage devices may be used as the external storage device 7. The HDD is a storage device for storing the control programs and various data. In the case where the ROM 3 does not store the control programs, the hard disk in the HDD may store the control programs, which may be transferred to the RAM 4 so that the CPU 1 can operate by reading the programs from the RAM 4 in a similar manner to the case where the ROM 3 stores such control programs. This is advantageous in that the addition and the up-grading of the program versions will be easily conducted.

The CD-ROM drive is a reading device for reading out the control programs and various data which are stored in a CD-ROM. The read-out control programs and various data are stored in the hard disk in the HDD. Thus it will be easy to newly install control programs or to up-grade the program versions. Other than the CD-ROM drive, the external storage device 7 may include a floppy disk drive (FDD), a magneto-optical (MO) disk device, and other devices utilizing various types of other storage media.

Down Loading Programs

The system 11 of the present invention is connected via the communication interface 9 with a communication network such as the local area network (LAN), the Internet and the telephone lines so that the system 11 can communicate with a server computer via the communication network 18. This configuration is used for down loading programs or data from a server computer when the control programs or the data necessary for the intended processing are not stored in the HDD of the external storage device 7. This system 11, as a client, transmits to a server computer a command requesting the down loading of the programs or the data via the communication interface 9 and the communication network 18. Upon receipt of such a command, the server computer delivers the requested programs or data to the system 11 via the communication network 18, and the system 11 receives these programs or data via the communication interface 9 and stores the same in the hard disk drive, thereby completing the down loading procedure.

Main Flow of Chord Recognition Processing

Figure 2:
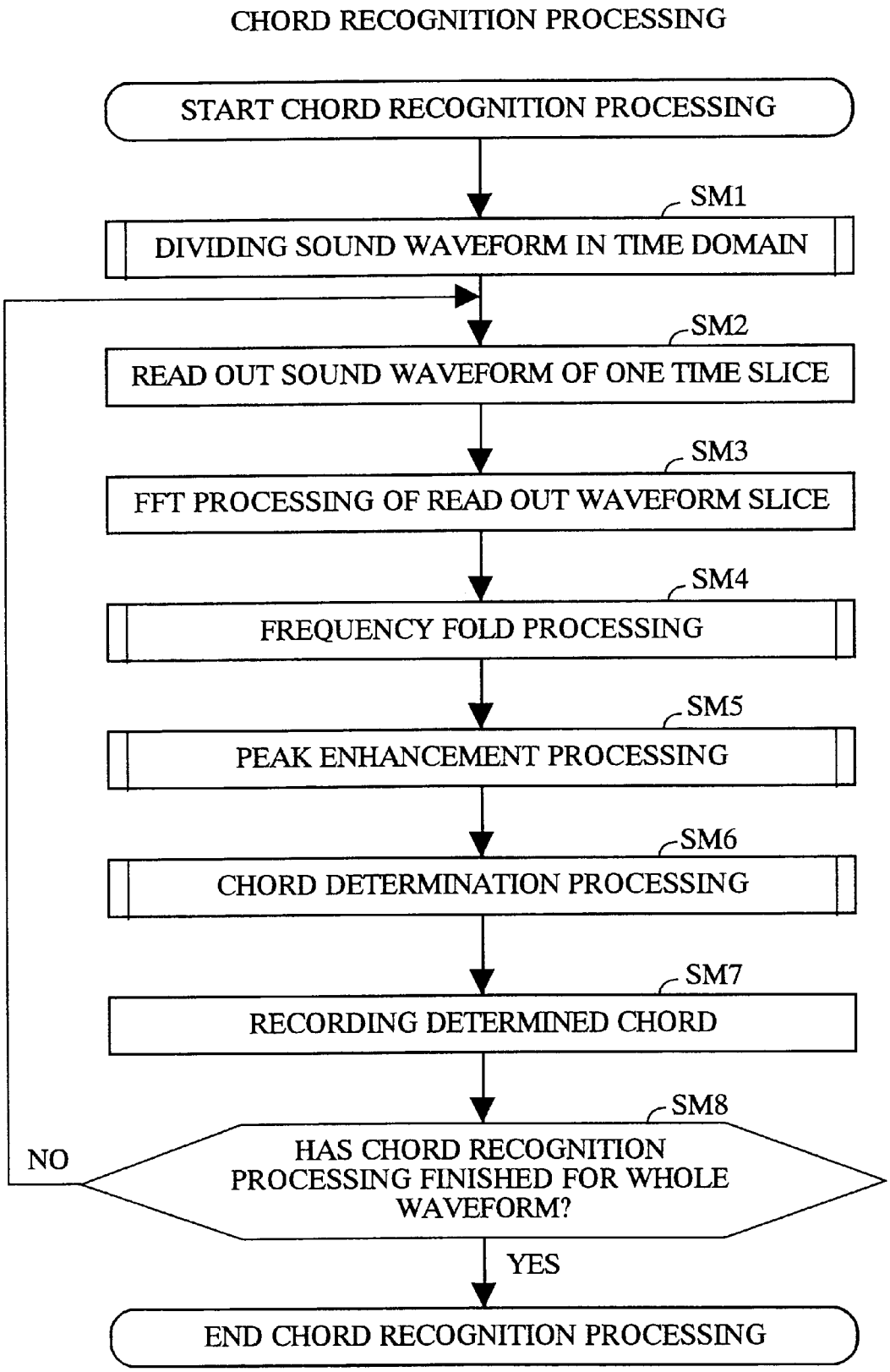
FIG. 2 is a flowchart showing a main routine of chord recognition processing in an embodiment of the present invention.

FIG. 2 is a flowchart showing a main routine of chord recognition processing in an embodiment of the present invention. The example of musical sound waveform data to be analyzed here is the data representing a piece of musical tune, which is obtained by sampling the musical sound waveform using the sampling frequency of, for example, 5.5 kHz. The sampling frequency of the waveform to be analyzed is not necessarily limited to this frequency and may be any other frequency. However, if the sampling frequency should be, for example, 44.1 kHz as employed in the conventional CD's, the number of analysis points by the FFT procedure would be 16384 for analyzing an amount of data corresponding to the duration of time of about 400 ms at a time, which accordingly increases the amount of calculations. The sampling frequency, therefore, should be determined at an adequate value taking these matters into consideration.

Referring to FIG. 2, the first step SM1 in the main routine of the chord recognition processing divides the above sampled waveform data into fractions or slices of a predetermined length in the time domain and stores the divided data in the predetermined areas of the RAM 4. One time slice (or fraction) in this example is the time length of about 400 ms corresponding to 2048 sample points under the sampling rate of 5.5 kHz. The portion of the musical waveform at or near the top (beginning) of the musical tune which apparently includes noise components may be considered unnecessary for the analysis and may be excluded from the subjects for analysis. The next step SM2 reads out the waveform data of an amount for one time slice from the RAM 4 in order to recognize chords of the divided time slices of the sound waveform successively (one time slice after another), steps SM3 through SM7 being repeated for the waveform data of each time slice.

The step SM3 performs an FFT processing of the read out waveform data of an amount of one time slice (fraction). The FFT processing converts the waveform data in the time domain into level data in the frequency domain constituting a frequency spectrum covering the frequency range of, for example, 0 Hz to 2750 Hz. The obtained data from the FFT processing is stored in the RAM 4 as a frequency spectrum file. The step SM4 cuts out a predetermined range of the frequency components data from the frequency spectrum file produced at the step SM3, and folds the frequency spectrum on an octave span basis and superposes the respective frequency components in octaval relationship. The predetermined range of frequency may, for example, be 63.5 through 2032 Hz. The folded (and superposed) frequency components data constitutes a crude octave profile P0 covering twelve semitone spans (i.e. an octave span) and is stored in a predetermined area of the RAM 4.

As the process moves forward to the step SM5, the crude octave profile P0 is subjected to a peak enhancement processing in order to clearly locate the peaks of the frequency component levels in the frequency spectrum. The peak enhancement processing conducts autocorrelation processing upon the crude octave profile P0 to obtain all enhanced octave profile Q containing more prominently exaggerated peaks. Next, the enhanced octave profile Q is folded (cut and superposed) on a semitone span basis to create a semitone profile S1 exhibiting a unique peak contour. Based on the frequency position of the peak and the shape of the contour of this semitone profile S1, the reference tone pitch of the incoming sound wave is interpreted and the deviation thereof from the reference tone pitch employed (and prevailing) in the data processing system of the apparatus is calculated. The enhanced octave profile Q is adjusted (fine-tuned) in pitch by the amount of the calculated deviation to make a profile PF, which is stored in the predetermined area of the RAM 4.

The following step SM6 compares the profile PF produced through the above steps SM3–SM5 with the previously prepared chord patterns by means of a pattern matching method and calculates the point representing the degree of likelihood of being a candidate for the chord of the analyzed sound waveform. Then, the step SM7 records the determined chord with the calculated point in the RAM 4 before moving to a step SM8.

The step SM8 judges whether the chord recognition processing through steps SM2 to SM7 has been finished or not with respect to the waveform data of all the time slices as divided by the step SM1. If the chord recognition processing has not finished for all the time slices of the sound waveform, the process goes back to the step SM2 to read out the next time slice of the divided sound waveform to repeat the chord recognition procedure. When the chord recognition processing has been finished for all the waveform slices, this main routine processing will come to an end.

Dividing Sound Waveform in Time Domain

Figure 3:
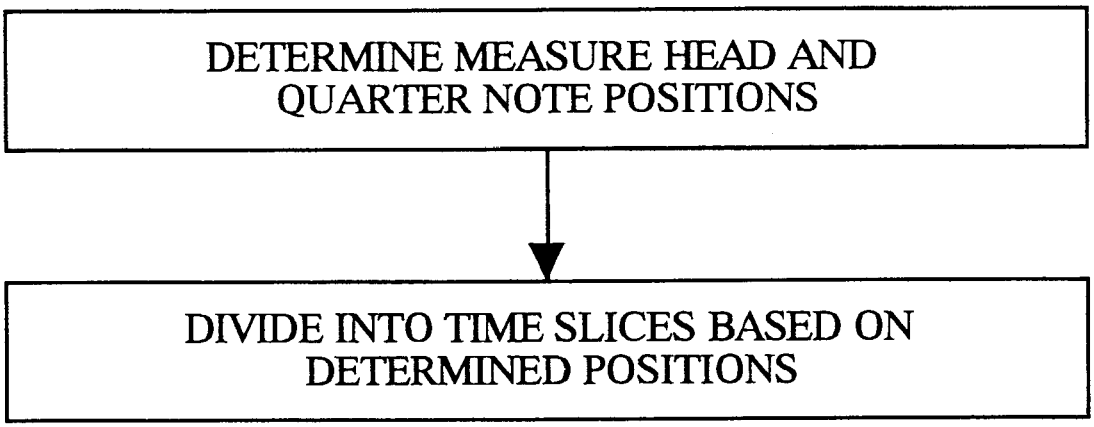
FIG. 3 is a flowchart showing an example of a subroutine for dividing a sound wave into fractions in the time domain.
Figure 4:
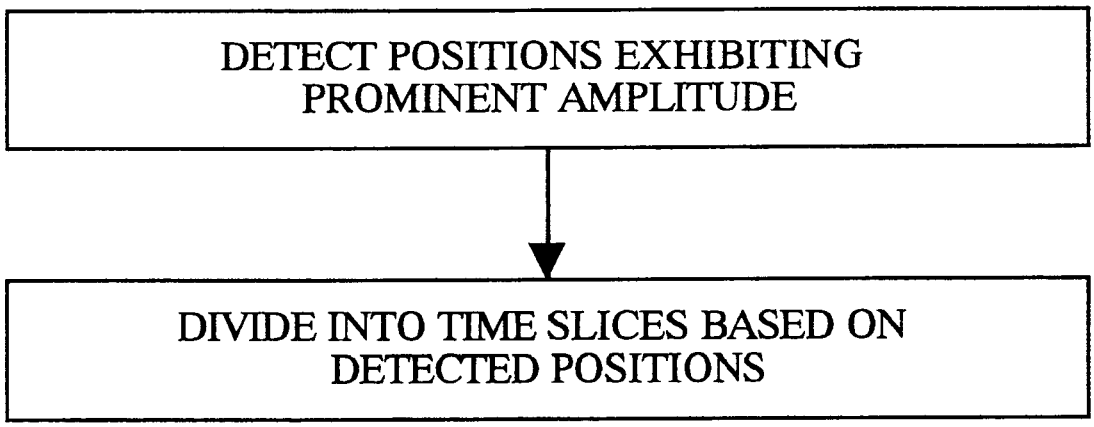
FIG. 4 is a flowchart showing another example of a subroutine for dividing a sound wave into fractions in the time domain.

FIGS. 3 and 4 are flowcharts each showing an example of a subroutine for dividing a sound waveform into fractions in the time domain as executed at the step SM1 in the main routine of FIG. 2. In FIG. 3, the time division is conducted based on the note positions, in which a step ST1 determines the locations of measure heads and quarter notes using a conventional procedure, and then, a step ST2 divides the sound waveform into fractions or slices in the time domain at the points of such measure heads and quarter notes, i.e. into slices of a quarter note duration. In FIG. 4, the time division is conducted based on the chord depressed positions, in which a step ST3 detects the positions in the waveform where the amplitudes are prominent relative to the other positions because such positions are very likely to be the positions where the chords are designated by depressing or playing plural notes simultaneously, and then, a step ST4 divides the sound waveform into fractions or slices in the time domain at the points of such prominent amplitudes, i.e. into slices of a chord duration.

Frequency Fold Processing

Figure 5:
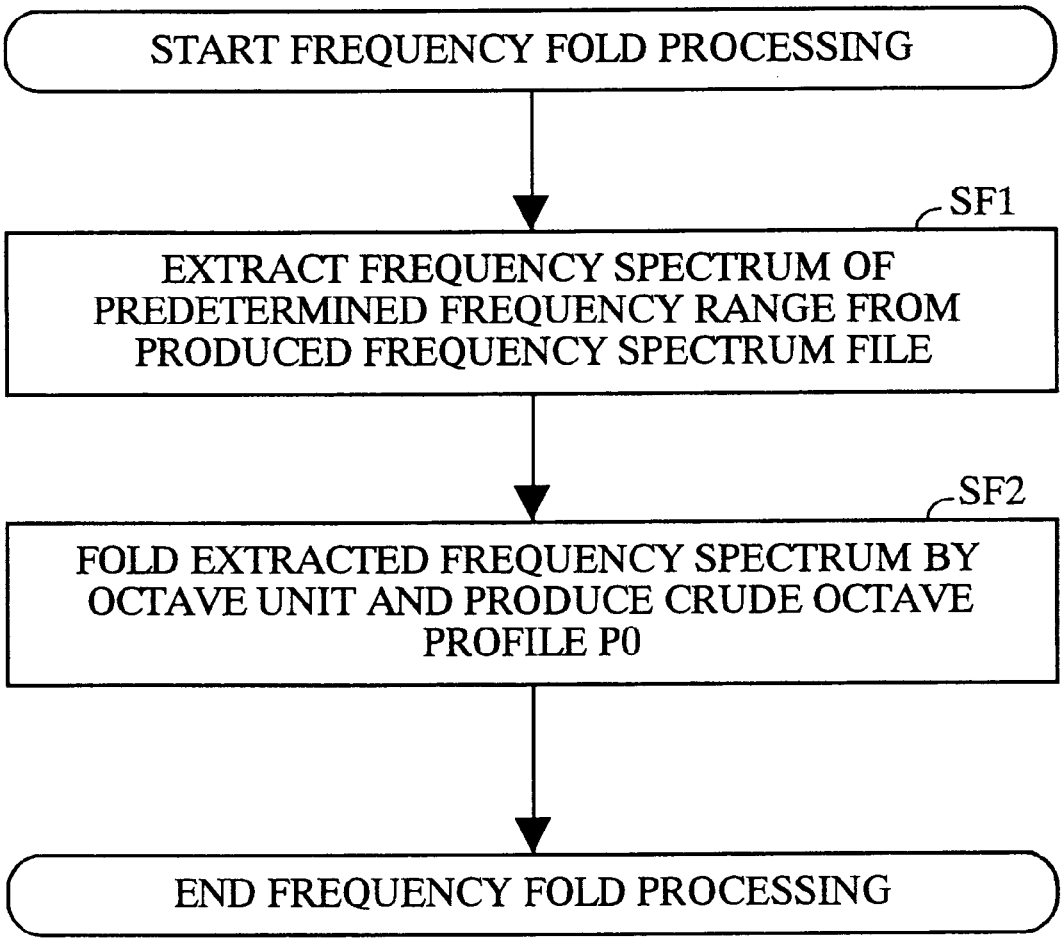
FIG. 5 is a flowchart showing an example of a subroutine of frequency fold processing.
Figure 6A:
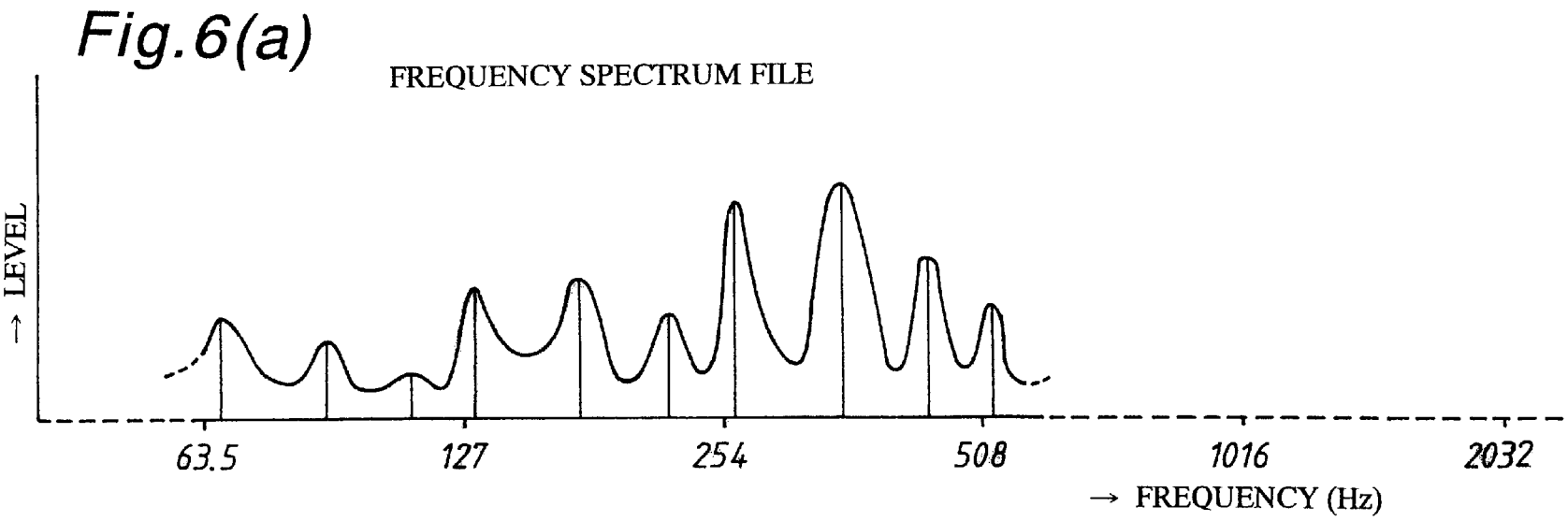
FIGS. 6(*a*) and 6(*b*) are graphs showing frequency spectra of a sound wave subjected to the chord recognition according to the present invention.
Figure 6B:
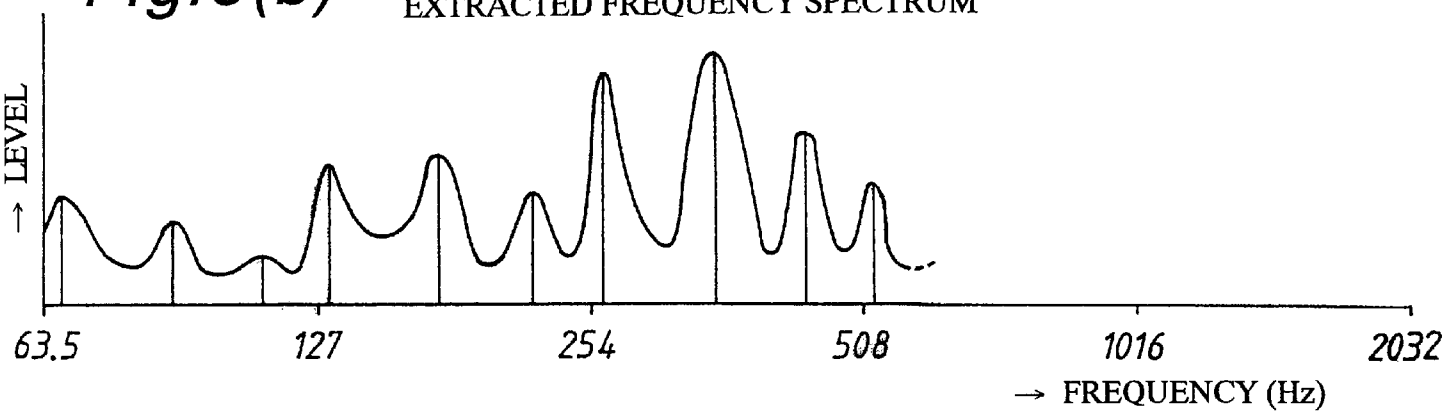

FIG. 5 is a flowchart showing in detail an example of a subroutine of the frequency fold processing as executed at the step SM4 in the main routine of FIG. 2. This subroutine includes two steps SF1 and SF2. The step SF1 extracts the frequency components in the analyzed frequency spectrum within a predetermined frequency range from the frequency spectrum file produced at the step SM3 in the main routine processing.

Where the sampling frequency of the sound waveform is 5.5 kHz, the frequency spectrum data stored in the frequency spectrum file in the RAM 4 after the FFT processing at the step SM3 in the main routine of FIG. 2 comprises frequency components ranging from 0 Hz to 2750 Hz as will be seen from FIG. 6(*a*). The step SF1 in FIG. 6(*b*) extracts the frequency spectrum data within the frequency range of 63.5 Hz through 2032 Hz from the above produced frequency spectrum file, which means fairly big amount of frequency components data are excluded as compared with the audible range of the human ear being approximately 20 Hz through 20,000 Hz. By using only such extracted limited range of frequency components for the succeeding processes, the amount of data processing will be greatly decreased and the noise components which may be included will also be greatly decreased, which realizes an efficient chord recognition.

The step SF2 folds (cuts and superposes) the above frequency spectrum data extracted at the step SF1 by the unit of one octave span to produce a crude octave profile P0. In this frequency folding process, the frequency spectrum is chopped into frequency widths of one octave and they are summed up over the one octave span, i.e. the frequency components which are octavally related with each other are added together so that the frequency components of the same named notes in different octaves are added together, which summed spectrum is herein called "a crude octave profile P0". The formation of the crude octave profile P0 clarifies the frequency components included in the subjected range of analysis from the viewpoint of note names within an octave, where only the note names define a chord and the octaves will not affect. Thus this procedure will enable a correct chord recognition.

Peak Enhancement Processing

Figure 7:
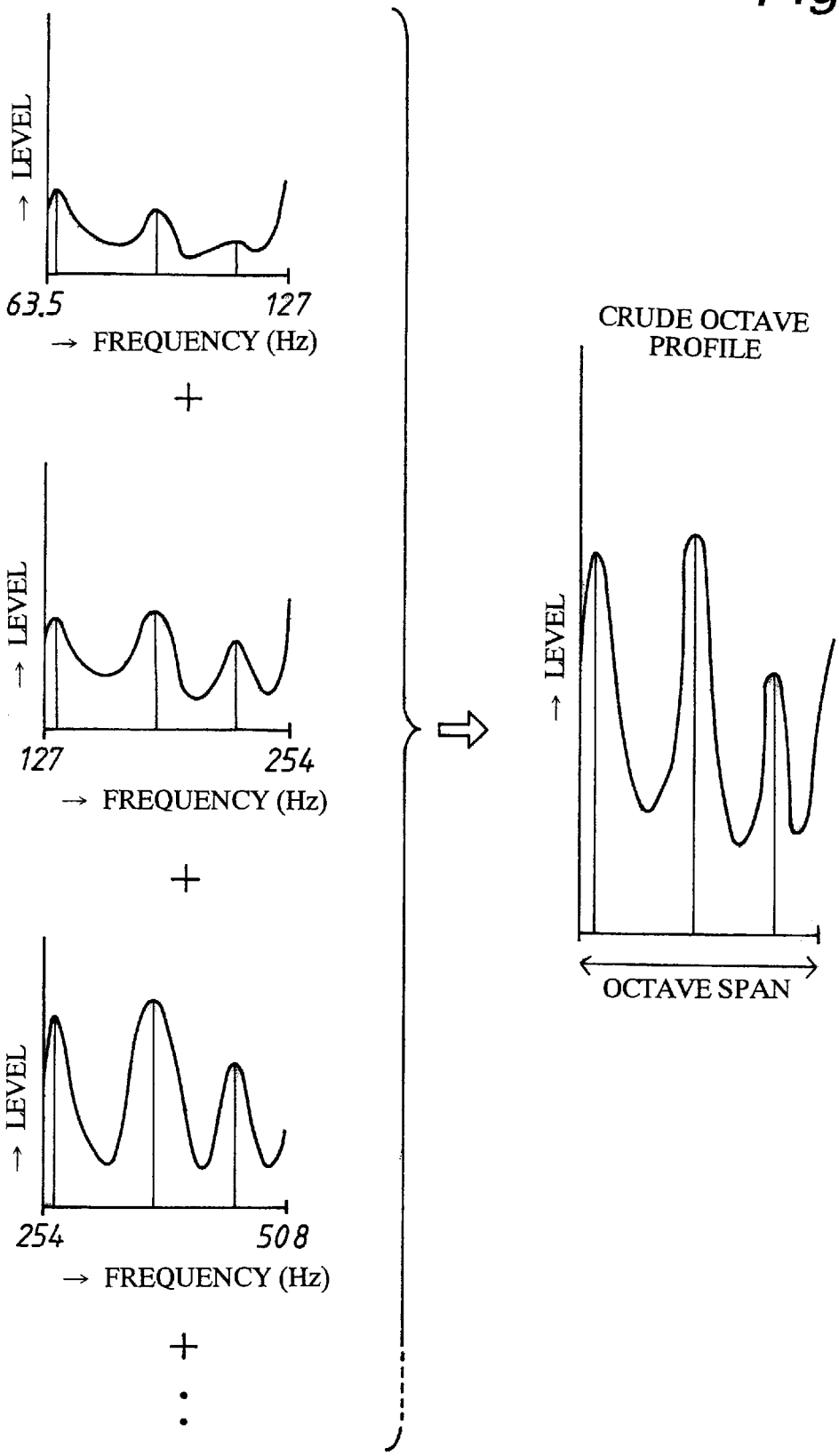
FIG. 7 is a chart including spectrum graphs for explaining the frequency fold processing.
Figure 8:
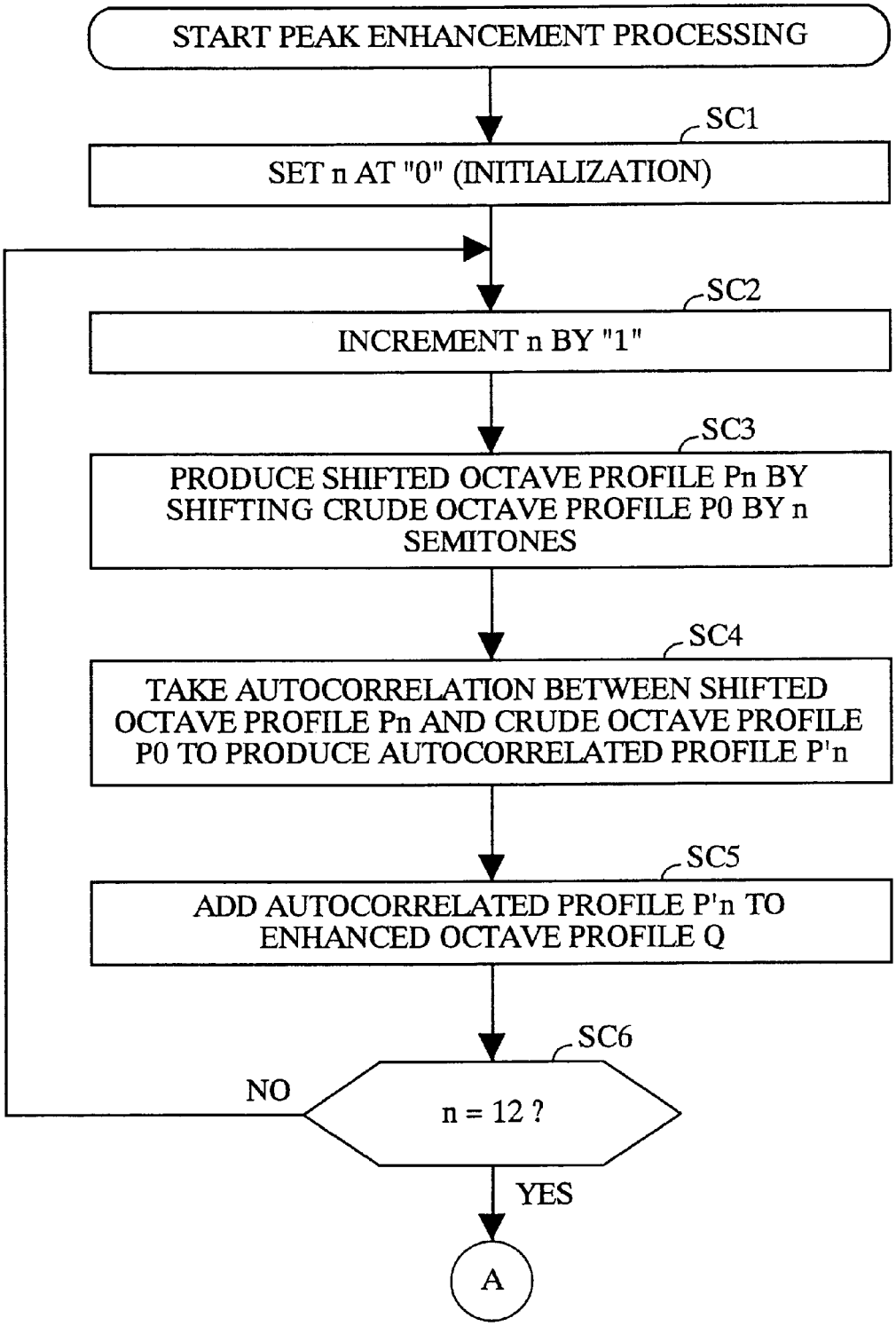
FIGS. 8, 9 and 10 are, in combination, a flowchart showing an example of a subroutine of peak enhancement processing.
Figure 9:
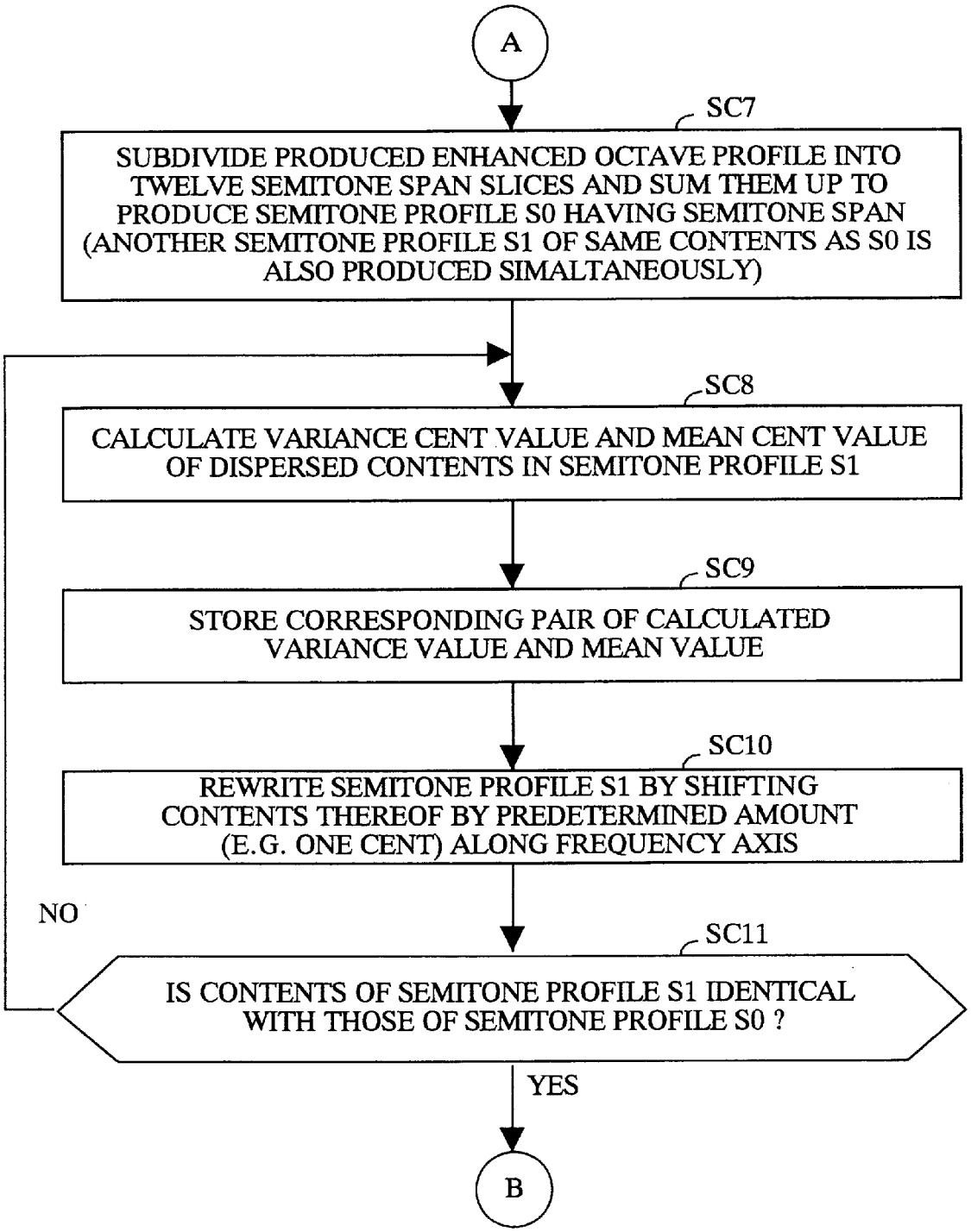
Figure 10:
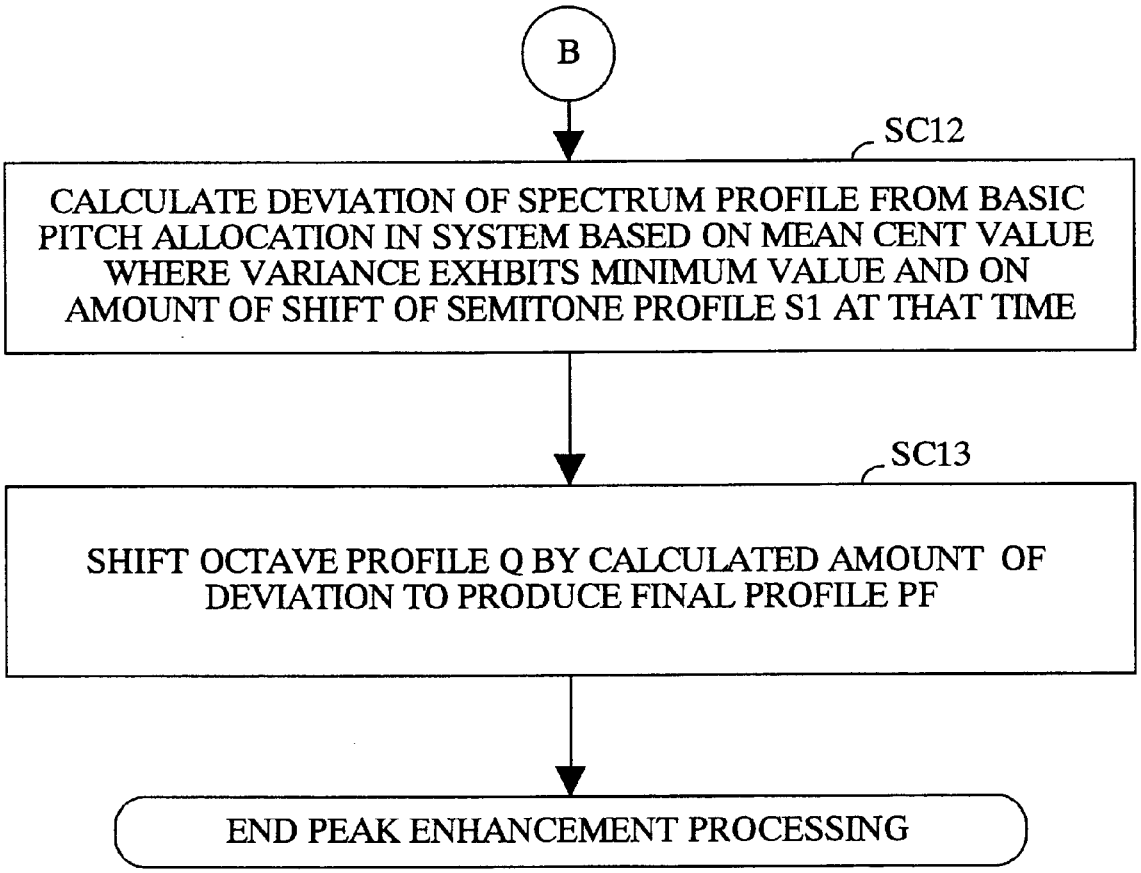

FIGS. 8, 9 and 10 are, in combination, a flowchart showing in detail an example of a subroutine of peak enhancement processing as executed at the step SM5 in the main routine of FIG. 2. This subroutine consists of two parts, the one being an autocorrelation processing including steps SC1 through SC6 and the other being a pitch adjustment processing including steps SC7 through SC13. The former group of steps SC1–SC6 takes autocorrelation between the variously shifted octave profiles Pn (n=1 to 12) and the crude octave profile P0 which has been produced at the frequency fold processing (step SM4 and FIGS. 5–7) in order to make the spectrum peaks more clear, while the latter group of steps SC7–SC13 adjusts (fine-tunes) the frequency position of the peaks using the variance check method in order to recognize the chords efficiently and accurately.

Autocorrelation Processing

The first step SC1 (FIG. 8) in the autocorrelation processing is to initialize the buffer value "n" (value range=0 to 11) by setting at "0" before moving to the next step SC2. The buffer "n" is a value that indicates how many semitones the crude octave profile P0 of the time fraction of the sound waveform under the current processing is shifted along the frequency axis. The step SC2 increments the value "n" by "1" (n=n+1) for the next step SC3 to form a shifted octave profile Pn by shifting the crude octave profile P0 by "n" semitones.

Let us assume that, for example, the crude octave profile P0 has H pieces of sample data per semitone and accordingly has 12H pieces of sample data for the span of twelve semitones (i.e. the whole span of the crude octave profile). Where the sample values of the crude octave profile P0 are expressed as P0[k] with k being 0, 1, 2, . . . , 12H−1 and representing the number of the sample data piece, the sample values Pn[k'] of the shifted octave profile Pn which is obtained by shifting the crude octave profile P0 by n semitones are expressed by the following equation (1):

$$Pn[k']=P0[(k+nH)\bmod 12H] \tag{1}$$

where "(k+nH)mod 12H" (=k') means the residue of the division of the value "k+nH" by the sample total "12H".

Then, the step SC4 takes autocorrelation between the shifted octave profile Pn and the crude octave profile P0 with respect to the respective intensity levels. In the above example, the autocorrelated profile P'n formed by the above autocorrelation process contains sample values P'n[k] as expressed by the following equation (2):

$$P'n[k]=P0[k]\times P0[(k+nH)\bmod 12H] \tag{2}$$

The succeeding step SC5 accumulates the autocorrelated profile P'n from the step SC4 (for n=1 to 12) to produce an accumulated octave profile Qn (by adding an autocorrelated profile P'n for every n value to the heretofore produced octave profile Q) to make an enhanced octave profile Q. In the above described example, therefore, the sample values Qn[k] of the accumulated octave profile Qn are obtained by cumulatively superposing the sample values P'n[k] of n autocorrelated profiles P'n using the following equation (3):

$$Qn[k]=\Sigma\, P'n[k] \tag{3}$$

Thereafter, the procedure moves forward to the step SC6 to judge whether the buffer value "n" has reached a value of "12". Where the buffer has not become "12" yet, the procedure goes back to the step SC2 to inclement the "n" value by "1" to repeat the processing through the steps SC2 to SC5, until n=12. When n=12, a finally enhanced octave profile Q has been produced as a result of the autocorrelation processing by the steps SC1 through SC6, and has sample values Q[k] as expressed by the following equation (4):

$$Q[k]=\sum_{n=0}^{11} P'n[k] \tag{4}$$

Figure 11:
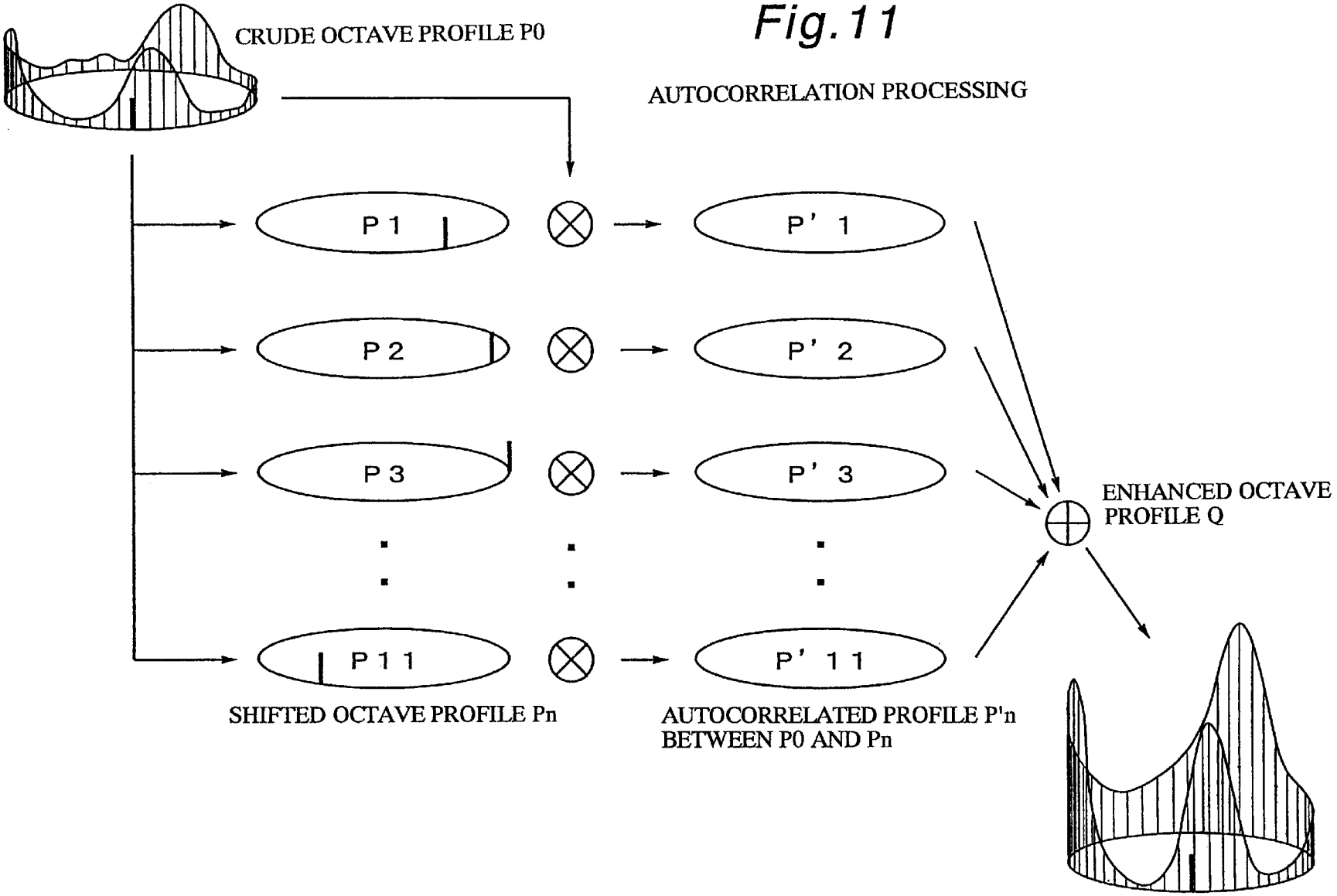
FIG. 11 is a chart showing how the autocorrelation processing takes place in the early stage of the peak enhancement processing.

FIG. 11 is an illustration of how the autocorrelation processing takes place at the above explained steps SC1 through SC6. The crude octave profile P0 (i.e. Pn where n=0) which is produced by the frequency fold processing routine (step SM4, and FIGS. 5–7) is depicted near the left up corner of FIG. 11. In the first stage of the autocorrelation processing, the crude octave profile P0 is ring-shifted by one semitone with n=1 to make a first shifted octave profiles P1. As a result of taking the autocorrelation between this shifted octave profile P1 and the crude octave profile P0, there will be obtained a first autocorrelated profile P1'.

Similarly to above, the second through eleventh stages of the autocorrelation processing ring-shift the crude octave profile P0 by successively increasing semitones (two semitones, three semitones, . . . , eleven semitones) to make a second through eleventh shifted octave profiles P2 through P11. An autocorrelation between the each of these shifted octave profiles P2 through P11 and the crude octave profile P0 is taken to obtain each of autocorrelated profiles P2' through P11'. Each of the profiles P2' through P11' is further added to the heretofore obtained octave profile Qn (n=1 to 10) which is a result of accumulation of autocorrelated profiles P1' through Pn' (n=1 to 10).

In this manner, after the eleventh stage of the autocorrelation processing, there is obtained an octave profile Q, which is Q11, as a result of the accumulation of all the autocorrelated profiles P1' through P11'. This profile Q will exhibit a peak-enhanced frequency spectrum having sharper or more prominent peak contours than the crude octave profile and including frequency components of exaggerated levels. Thus, this profile Q is herein referred to as an "enhanced octave profile" as already named in the above.

That is, the amplitude levels of the frequency components which correspond to the respective musical note pitches are naturally larger than other frequency components (the levels of the actually existing notes are still more so) and are positioned at semitone intervals, and therefore, as the autocorrelated profiles P'n of a semitone step are accumulated one after another successively, the amplitude levels at the frequency positions corresponding to the notes will accordingly increase prominently as compared with the rest of the positions. By adding together the levels of the frequency components at a semitone interval, the amplitude levels at the frequency positions corresponding to the respective musical notes becomes prominent (projecting) than the levels at other frequency positions, which will clearly locates the note existing positions on the frequency axis.

Fine Adjustment of Reference Pitch

Figures 12A, 12B, 12C, 12D:
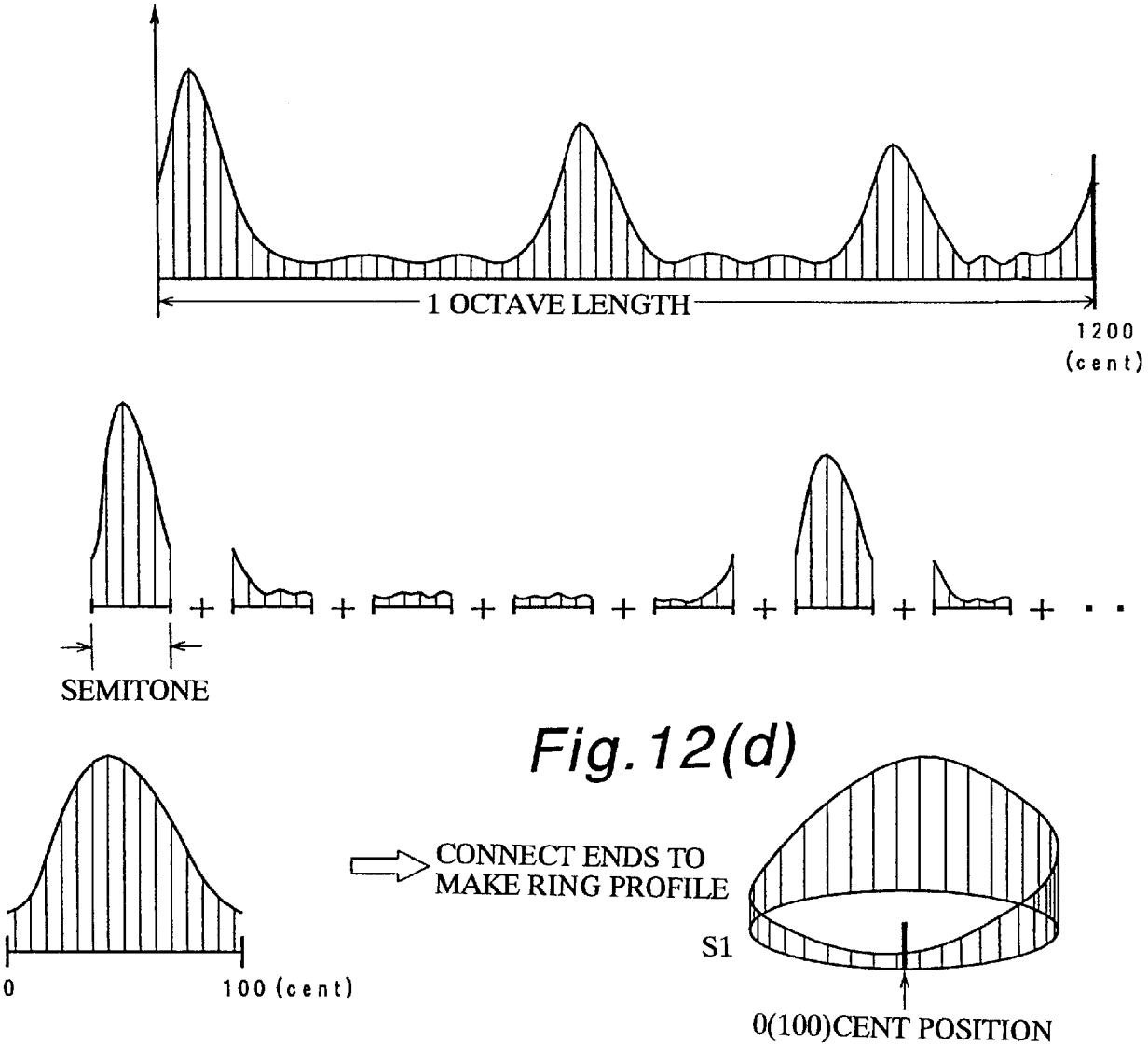
FIGS. 12(*a*), 12(*b*) and 12(*c*) are charts showing how the semitone profile producing processing takes place in the middle stage of the peak enhancement processing.

The remaining part of the peak enhancement processing is the processing for fine adjustment of the reference tone pitch through the steps SC7 to SC13 as described in FIGS. 9 and 10. FIGS. 12(*a*), 12(*b*) and 12(*c*) illustrate how the semitone profile producing processing takes place at the step SC7 in FIG. 9. The enhanced octave profile Q is a set of data representing exaggerated content levels over the frequency range of one octave (1200 cents) span. Where the tones included in the incoming sound waveform are of the notes in the equally tempered musical scale, every actual tone used there is positioned at a position which is deviated from the standard note pitch in the musical scale under the reference tone pitch (A4=440 Hz) employed in the system of the apparatus by a certain constant amount in cents, and each peak can be assumed to present a symmetrical contour or shape. Thus, the deviation (difference) of the reference tone pitch of the incoming musical sound wave from the reference tone pitch of the data processing system in the apparatus is detected based on the assumption of symmetry, and the frequency spectrum of the sound wave is pitch-adjusted by such a detected deviation amount so that the note existing frequency positions of the sound waveform under analysis and the note existing frequency positions of the processing system will agree with each other. Then, the pattern matching tests will be efficiently conducted in the succeeding chord recognition procedure. The present invention employs a semitone profile to accurately and precisely detect the deviation amount.

Hereinbelow will be described the fine adjustment of the reference pitch in more detail with reference to FIGS. 9 and 10. First, the step SC7 subdivides the enhanced octave profile (FIG. 12(*a*)) produced tough the steps SC1 to SC6 of the above described autocorrelation processing into twelve parts of a semitone span (100 cents unit) as shown in FIG. 12(*b*) and sum (superpose) them up in a semitone span to make a semitone profile S0 (FIG. 12(*c*)), which in turn is stored in the RAM 4. The processing of summing up or superposing the semitone pieces of the frequency spectrum means to add amplitude levels of the frequency components at the corresponding frequency positions (cent positions) in the twelve equally divided spectra each having a span of 100 cents along the frequency axis. The step SC7 further connects the 0-cent end and the 100-cent end of this semitone prose S0 to make a ring-shaped semitone profile S1 for storing in the RAM 4.

An example of finding a peak position in the semitone profile S0 may be a method of locating the peak at a position where the differential (the derivative function) of the profile S1 changes from positive to negative. But such a method may not correctly locate the peak position, if the waveform data includes lots of noise components. Therefore, in this invention, a ring-connected semitone profile S1 is employed to be successively shifted by a small amount (e.g. 1 cent) for obtaining the variance of the profile at every shift, and the genuine peak position of the semitone profile S0 is determined from the shift value which gives the minimum variance value. This method assures the determination of the difference between the reference tone pitch of the incoming tone waveform and the reference tone pitch of the apparatus system, making the subsequent chord determination more reliable.

The looped processing by the steps SC8 through SC11 calculates the variance value and the mean value at each shift position of the ring semitone profile S1 so that the step SC12 can determine the deviation of the semitone profile S0. In order to locate the peak position of the semitone profile S0, the mean cent value $\mu$ is determined from the weighted mean value km, which corresponds to the gravity center of the distributed components so that the greatest peak point can be estimated at such a $\mu$ position. As the semitone profile S0 presents a ring connected configuration, an idea of "variance" is introduced as will described later, and the mean value at the distribution shape which gives the minimum variance "$\sigma^2$" will locate the most reliable peak position. For that purpose, the deviation values of the semitone profile S0 are calculated to realize the above method.

At the step SC8, a variance cent value "$\sigma^2$" and a mean cent value "$\mu$" are calculated with respect to the ring semitone profile S1 before the process moves forward to the step SC9. The step SC9 pairs the corresponding variance value "$\sigma^2$" and mean value "$\mu$" and stores the paired variance value "$\sigma^2$" and mean value "$\mu$" at the predetermined buffer areas in the RAM 4 before moving forward to the step SC10. The step SC10 rewrites the semitone profile S1 by shifting the contents of the ring semitone profile S1 by a predetermined amount, for example one cent along the frequency axis before moving to the step SC11.

The step SC11 examines whether the contents of the semitone profile S1 as shifted at the step SC10 are identical with the contents of the semitone profile S0. Where the both are not identical, the process goes back to the step SC8 to repeat the processing by the steps SC8 through SC10 until the step SC11 judges that the both are identical. When the successive shifting of the ring semitone profile S1 has gone one round to come back to the original position of the semitone profile S0, the step SC11 judges that both semitone profiles S1 and S0 are identical in contents, and directs the process to the step SC12.

The step SC12 calculates the deviation of the spectrum profile of the incoming sound waveform being analyzed from the basic pitch allocation (i.e. the reference tone pitch) of the system based on the mean cent value $\mu$ where the variance $\sigma^2$ becomes minimum and on the amount of shift of the semitone profile S1 at such a time. And the next step SC13 shifts the octave profile Q by the amount of deviation as calculated at the step SC12 and stores thus shifted octave profile Q in the predetermined area of the RAM 4 as a final profile PF, thereby ending the peak enhancement processing.

Figure 13A:
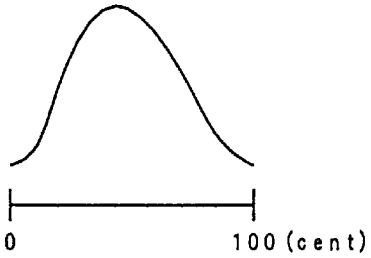
FIGS. 13(*a*) and 13(*b*) are charts showing how the semitone profile is shifted variously to find the condition presenting the minimum variance.
Figure 13B:
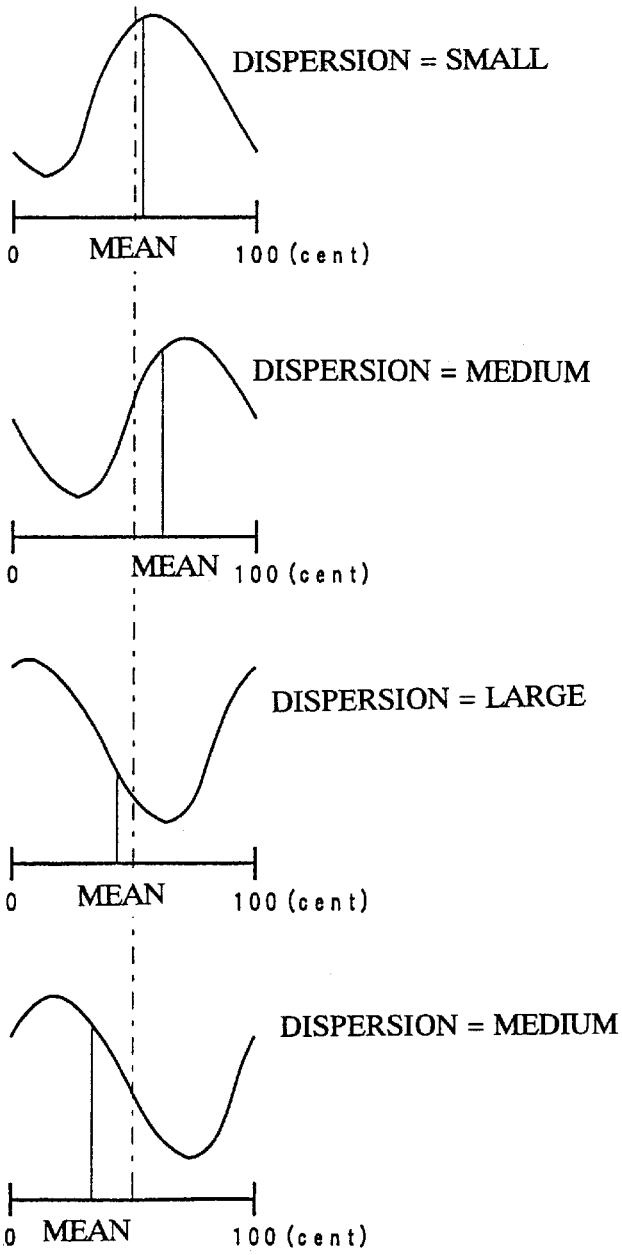

FIGS. 13(*a*) and 13(*b*) illustrate how the semitone profile is shifted variously to find the condition presenting the minimum variance for the fine adjustment of the reference tone pitch as executed at the above described steps SC8 through SC11. In FIG. 13(*a*) shows a semitone profile S0, while FIG. 13(*b*) illustrates several conditions of the semitone profiles S1 at several typical shifted positions together with the variance values (dispersions) and the mean positions. The semitone profile S1 is shifted by a predetermined amount, for example one cent, at the step SC10 accumulatively, and at each shifted condition the variance (dispersion) value and the mean value are calculated, for example, in the following way.

The semitone profiles S0 and S1, according to the aforementioned example, includes H pieces of frequency components data, which data pieces are expressed as S[k] using a data number k (k=0 to H−1) and the weighted mean km of the data number k and the mean cent value $\mu$ are respectively expressed by the following equations (5) and (6):

$$km = \sum_{k=0}^{H-1} k \times S[k] \Big/ \sum_{k=0}^{H-1} S[k] \tag{5}$$

$$\mu = km \times 100 / H \tag{6}$$

And the variance value $\sigma^2$ is expressed by the following equation (7) using the weighted mean value km $$\sigma^2 = \sum_{k=0}^{H-1} (k - km)^2 \times S[k] \Big/ \sum_{k=0}^{H-1} S[k] \tag{7}$$

Chord Determination Processing

Figure 14:
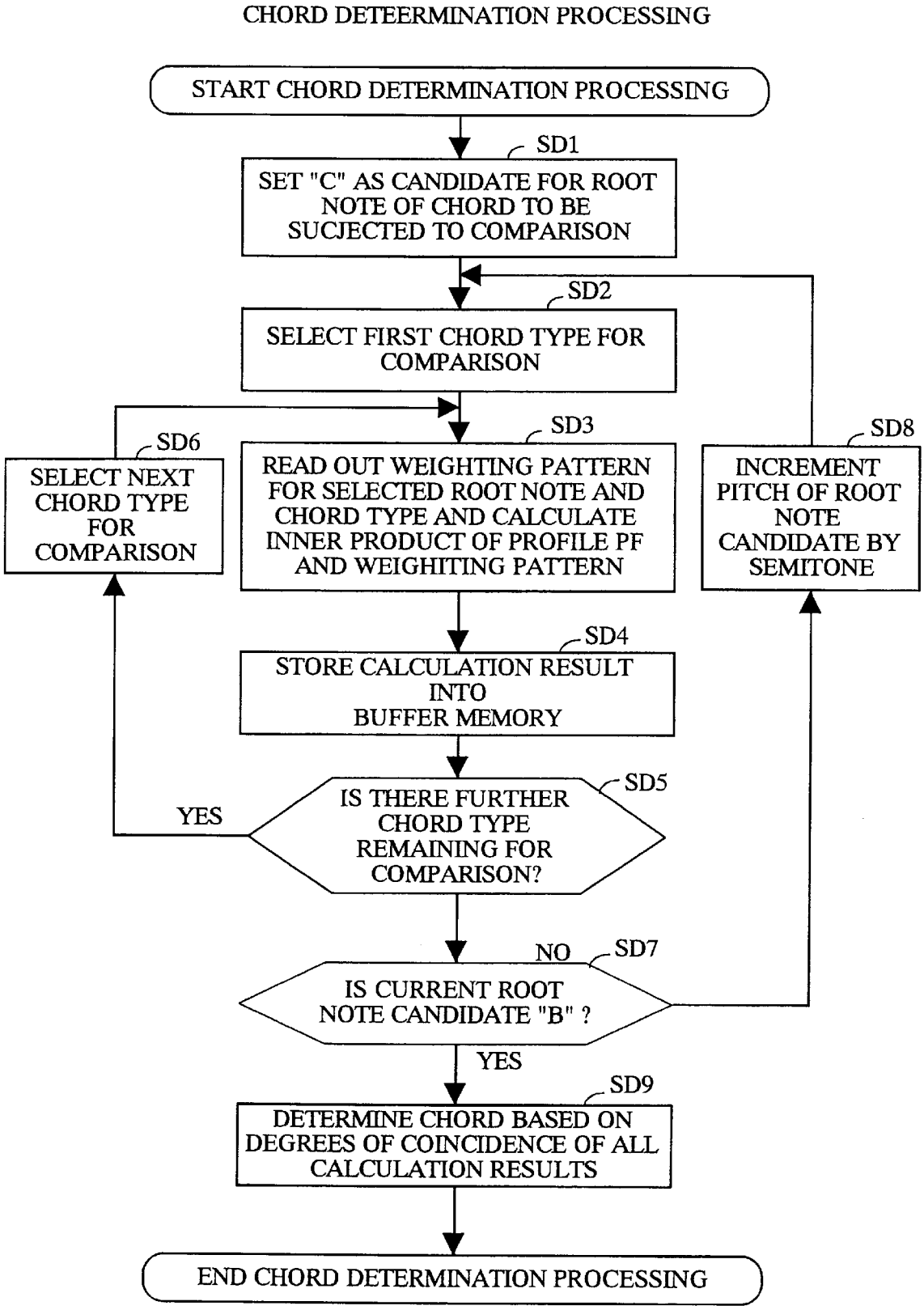
FIG. 14 is a flowchart showing an example of chord determination processing.

FIG. 14 is a flowchart showing an example of the chord determination processing as executed at the step SM6 in the main routine of FIG. 2. This subroutine calculates the points by making the inner product (scalar product) of the above obtained final profile PF (as obtained at the end of the peak enhancement processing) and each of a plurality of previously prepared weighting pattern and determines the chord based on the total sum of the calculated points.

At the first step SD1 in this subroutine, the reference point (for example, the point for the note "C") of the ring profile PF is taken as the center of the first (top) semitone span (zone) of the profile PF, and the note "C" is set as the first candidate root note of the chord to be compared with the profile PF. In the illustrated example where the lowest end of the frequency range for the frequency spectrum to be extracted at the first step SF1 (in FIG. 5) of the frequency fold processing is selected at 63.5 Hz as shown in FIG. 6(*b*), the first semitone span or zone of the profile PF includes the C note at its center, which means that the first semitone zone covers the range of approximately from C note minus 50 cents to C note plus 50 cents. And in the next step SD2, the first candidate of chord type is selected, for example a "major chord" is selected. Thus a C major chord, for example, is selected as the comparison candidate with the profile PF in the pattern matching method, before moving forward to a step SD3.

The step SD3 reads out a weighting patterns for the selected root note and chord type from among the weighting patterns for various chord types, and calculates an inner product of the read out pattern and the profile PF. The weighting patterns are data representing pitch differences among the chord constituting notes and the weighting factors for the respective notes, and are previously stored in the ROM 3 in correspondence to a plurality of chords. The succeeding step SD4 writes in the calculation result at the corresponding chord candidate area of an inner product points buffer memory, before moving to a step SD5.

The step SD5 judges whether there is ether chord type candidate remaining for comparison, and if there is any chord type candidate remaining for comparison, the process goes back to the step SD3 via a step SD6, wherein the next chord type candidate is selected for further comparison with the subject profile PF. These steps SD3 through SD6 are repeated for the same root note using different weighting patterns corresponding to different chord types to take inner products with the subject profile PF, calculating the respective points about the inner products. When the step SD5 judges that there is no other chord type remaining for comparison with the profile PF, the process moves forward to a step SD7.

The step SD7 is to check whether the comparison is over for all the root note, and judges whether the root note of the comparison chord candidate is "B", which is the last note in the octave. Where the root note has not reached B note yet, the process moves to a step SD8 to increment the pitch of the root note candidate by one semitone, for example from F to F#, before going back to the step SD2. Thereafter, the processing by the steps SD3 through SD6 is repeated for the new root note.

When all the inner products have been calculated with respect to all root notes and all chord types and accordingly all boxes of the buffer table have been filled by the calculated inner product points, the step SD7 judges that the root note of the comparison chord candidate has reached the last octaval note "B" so that the process moves to a step SD9, which determines the chord constituted by the profile PF, i.e. the chord of the sound waveform fraction under analysis, from all the calculated degrees of coincidence or similarity upon reviewing the matrix of the inner product points.

Figure 15A:
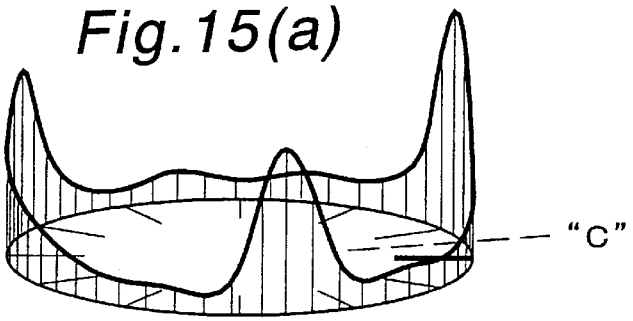
FIGS. 15(*a*), 15(*b*) and 15(*c*) are charts illustrating how a chord is determined.
Figure 15B:
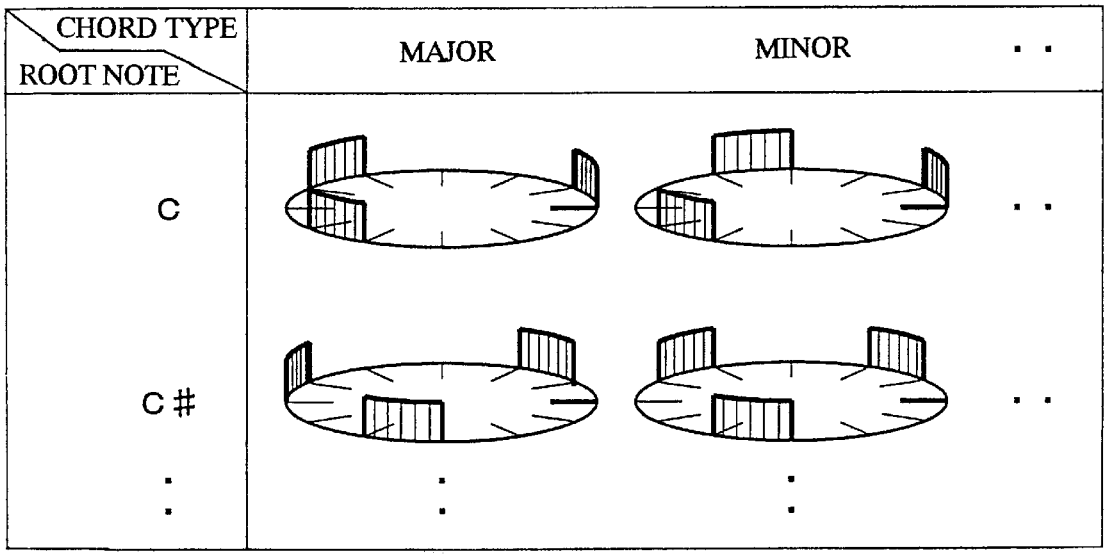
Figure 15C:
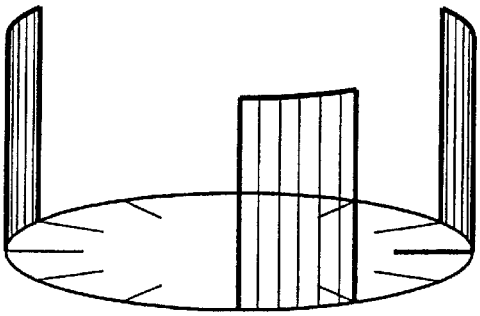
Figure 16:
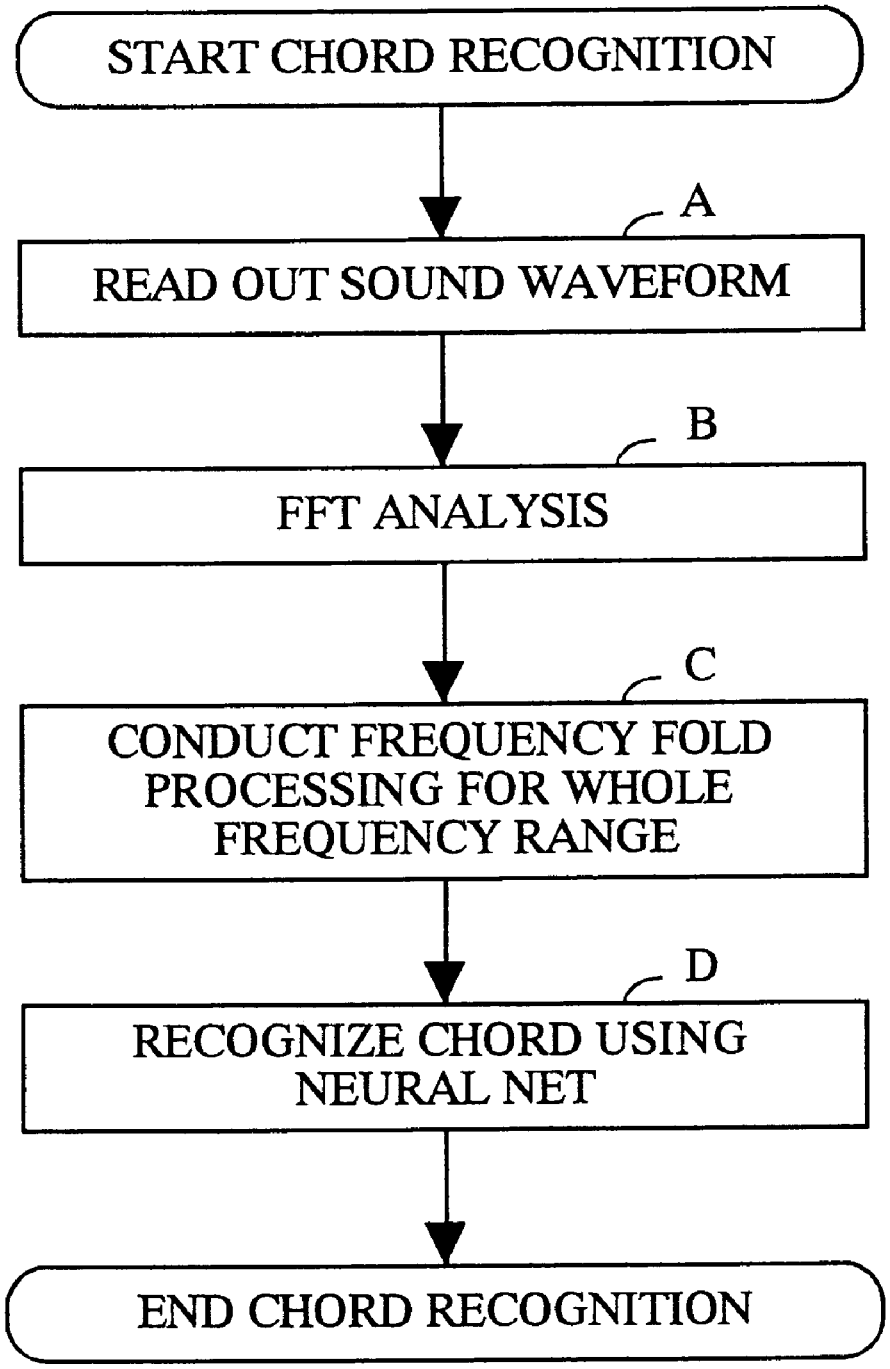
Fig. 16 PRIOR ART
FIG. 16 is a flowchart showing a chord recognizing process in the prior art.

FIGS. 15(*a*), 15(*b*) and 15(*c*) illustrate the outline of how a chord is determined using a pattern matching method. In these figures, twelve notch lines (one being thick) in each circle indicate the borders between the adjacent two among the twelve semitones, and the thick line indicates the lower border of the first semitone zone for the C note. It is so designed that the frequency position of each note is at the center of the semitone zone. For example, the position of the C note, which is at 65.4 Hz is indicated by a thin broken line in FIG. 15(*a*) and is positioned at the midway between the thick line and the first thin line in the counterclockwise direction.

FIG. 15(*a*) illustrates the profile PF of an octave span which is ring-connected, in a perspective view. The thick wavy line at the top edge of the crown-shaped ring profile PF indicates the envelope of the amplitude values of respective frequency components as is the case in the hereinabove examples of various profiles. FIG. 15(*b*) shows several examples of the weighting patterns as the chord candidates in an extremely schematic fashion. Rectangular standing walls (partially cylindrical) on the ring represent the weighting factors for the chord constituent notes of the respective chord, wherein the weighting factor in each semitone zone which corresponds to a chord constituent note is "1" and those in other semitone zones are all "0" (zero).

In this embodiment, the weighting patterns of FIG. 15(*b*) are placed with the thick reference line in alignment with the lower border of the C note zone as in the case of the profile PF. That is, the reference point of the weighting pattern and the reference point of the profile PF are positioned in alignment.

The next job is to calculate the inner product between the profile PF and each of the weighting patters to get the point. The corresponding elements (amplitude in the profile and weighting factor in the pattern) at each corresponding positions are multiplied with respect to the profile PF and the weighting pattern PTn, and the sum total Ai (i being the number of chord candidates, i=1, 2, . . . ) of such multiplication products. For the sake of simplicity in calculation, all component amplitudes within each semitone zone may be summed up for the profile PF so that each semitone zone is represented by a single value, and the weighting factor for each semitone zone may be represented by a single value of "1", thereby calculating the sum of the multiplication products each between the above-mentioned amplitude sum and the weighting factor. Then the resultant view of such a simplified calculation would be as shown in FIG. 15(*c*), in the case of a high matching degree.

The calculated result Ai of the inner product between the profile PF and the respective chord candidates are recorded in the inner product buffer with respect to each chord type and each root note. As the inner product calculation as described will be conducted for all the weighting patterns, and the chord in question is determined to be the chord that gives the greatest earned point among various Ai (total of multiplication products) as a result of the inner product calculation with the respective weighting patterns.

Although the invention is described with reference to one embodiment in the above, the autocorrelation processing in the early stage of the peak enhancement processing as described above may be omitted according to such a simplicity requirement.

Further, in the embodiment, the inner product values between the produced profile PF and the previously provided weighting patterns are used for determining the chord, but the method for determining the chord is not necessarily be limited to such a manner, and may be otherwise. A chord may well be determined only if the feature of the peak values and positions are taken into consideration for comparison with the features of the chords. Further, a preferable method will be to see the feature of the sound spectrum meets which of the characteristic patterns in the previously provided chords. This may be advantageous in that the characteristic patterns for the respective chords may be intentionally controlled according to the operator's preference.

Any computer programs necessary for the above processing may be recorded on a machine readable media so that a computer system may be configured to operate as a chord recognizing apparatus of the present invention when controlled by such programs. Also various manners of technology prevailing in the computer field may also be available.

While several forms of the invention have been shown and described, other forms will be apparent to those skilled in the art without departing from the spirit of the invention. Therefore, it will be understood that the embodiments shown in the drawings and described above are merely for illustrative purposes, and are not intended to limit the scope of the invention, which is defined by the appended claims.

What is claimed is:

1. An apparatus for recognizing musical chords from incoming musical sound wave data representing a musical sound wave of a musical performance including musical tones based on a reference tone pitch of the musical performance, said apparatus comprising:

a frequency component extracting device which extracts frequency components in the form of a frequency spectrum having peaks in level from said incoming musical sound wave data;

a frequency range cutting out device which cuts out frequency component data included in a predetermined frequency range from said extracted frequency component data;

an octave profile creating device which folds and superpose the cut-out frequency component data on the basis of the frequency width of an octave span to create an octave profile of the musical sound wave in the form of a frequency spectrum having peaks in level, said octave span being defined based on a reference tone pitch predetermined for the apparatus;

a pitch adjusting device which detects a deviation of the reference tone pitch of said incoming musical sound wave from the reference tone pitch in the apparatus and shifts the frequency axis of said octave profile by the amount of said detected deviation;

a reference chord profile providing device which provides reference chord profiles respectively for a plurality of chord types, each chord profile exhibiting a pattern of frequency components existing at frequency zones each of a semitone span corresponding to chord constituent tones for said each chord type; and a chord determining device which compares the pitch-adjusted octave profile with said reference chord profiles to find a reference chord profile that coincides with said pitch-adjusted octave profile, thereby determining the chord established by the incoming sound wave.

2. An apparatus for recognizing musical chords according to claim 1, further comprising:

an autocorrelation device which takes the autocorrelation among the frequency components in said octave profile on the basic unit of a semitone span in order to enhance said peaks in the frequency spectrum of said octave profile on a semitone basis.

3. An apparatus for recognizing musical chords according to claim 1, in which said pitch adjusting device includes:

a semitone profile creating device which folds and superposes said octave profile on a semitone span basis to create a semitone profile exhibiting a folded frequency spectrum over a semitone span;

a semitone profile ring-shifting device which ring-shifts said semitone profile by a predetermined pitch amount successively, one shift after another shift, to calculate a variance at each said shift;

a deviation detecting device which detects the deviation amount of the reference tone pitch of said semitone profile from the reference tone pitch of the apparatus based on the shift amount that gives the minimum variance value among the calculated variances for the respective shifts; and a pitch shifting device which shifts said octave profile by the amount of said detected deviation toward said reference pitch of the apparatus.

4. An apparatus for recognizing musical chords according to claim 2, in which said pitch adjusting device includes:

a semitone profile creating device which folds and superposes said octave profile on a semitone span basis to create a semitone profile exhibiting a folded frequency spectrum over a semitone span;

a semitone profile ring-shifting device which ring-sifts said semitone profile by a predetermined pitch amount successively, one shift after another shift, to calculate a variance at each said shift;

a deviation detecting device which detects the deviation amount of the reference tone pitch of said semitone profile from the reference tone pitch of the apparatus based on the shift amount that gives the minimum variance value among the calculated variances for the respective shifts; and a pitch shifting device which shifts said octave profile by the amount of said detected deviation toward said reference pitch of the apparatus.

5. An apparatus for recognizing musical chords according to claim 4, in which said reference chord profile providing device provides each of said reference chord profiles in the form of weighting values for the respective frequency components existing in said frequency zones each of a semitone span; and in which said chord determining device multiplies the levels of the frequency components in said pitch-adjusted octave profile in each semitone span and said weighting values in each semitone span, the multiplication being conducted between each corresponding pair of frequency components in the respective semitone spans, and sums up the multiplication results to determine the chord of said sound wave.

6. A method for recognizing musical chords from incoming musical sound wave data representing a musical sound wave of a musical performance including musical tones based on a reference tone pitch of the musical performance, said method comprising the steps of:

extracting frequency components in the form of a frequency spectrum having peaks in level from said incoming musical sound wave data;

cutting out frequency component data included in a predetermined frequency range from said extracted frequency component data;

folding and superposing the cut-out frequency component data on the basis of the frequency width of an octave span to create an octave profile of the musical sound wave in the form of a frequency spectrum having peaks in level, said octave span being defined based on a reference tone pitch predetermined for the method;

detecting a deviation of the reference tone pitch of said incoming musical sound wave from the reference tone pitch in the apparatus;

shifting the frequency axis of said octave profile by the amount of said detected deviation;

providing reference chord profiles respectively for a plurality of chord types, each chord profile exhibiting a pattern of frequency components existing at frequency zones each of a semitone span corresponding to chord constituent tones for said each chord type; and comparing the pitch-adjusted octave profile with said reference chord profiles to find a reference chord profile that coincides with said pitch-adjusted octave profile, thereby determining the chord established by the incoming sound wave.

7. A method for recognizing musical chords according to claim 6, further comprising the step of:

taking the autocorrelation among the frequency components in said octave profile on the basic unit of a semitone span in order to enhance said peaks in the frequency spectrum of said octave profile on a semitone basis.

8. A method for recognizing musical chords according to claim 6, in which said step of detecting a deviation of the reference tone pitch includes the steps of:

folding and superposing said octave profile on a semitone span basis to create a semitone profile exhibiting a folded frequency spectrum over a semitone span;

ring-shifting said semitone profile by a predetermined pitch amount successively, one shift after another shift, to calculate a variance at each said shift; and detecting the deviation amount of the reference tone pitch of said semitone profile from the reference tone pitch of the apparatus based on the shift amount that gives the minimum variance value among the calculated variances for the respective shifts.

9. A method for recognizing musical chords according to claim 8, in which said step of providing reference chord profiles provides each of said reference chord profiles in the form of weighting values for the respective frequency components existing in said frequency zones each of a semitone span; and in which said step of comparing the pitch-adjusted octave profile includes the step of multiplying the levels of the frequency components in said pitch-adjusted octave profile in each semitone span and said weighting values in each semitone span, the multiplication being conducted between each corresponding pair of frequency components in the respective semitone spans, and the step of summing up the multiplication results to determine the chord of said sound wave.

10. A machine readable medium for use in an apparatus for recognizing musical chords from incoming musical sound wave data representing a musical sound wave of a musical performance including musical tones based on a reference tone pitch of the musical performance, said apparatus being of a data processing type comprising a computer, said medium containing program instructions executable by said computer for executing:

a process of extracting frequency components in the form of a frequency spectrum having peaks in level from said incoming musical sound wave data;

a process of cutting out frequency component data included in a predetermined frequency range from said extracted frequency component data;

a process of folding and superposing the cut-out frequency component data on the basis of the frequency width of an octave span to create an octave profile of the musical sound wave in the form of a frequency spectrum having peaks in level, said octave span being defined based on a reference tone pitch predetermined for the apparatus;

a process of detecting a deviation of the reference tone pitch of said incoming musical sound wave from the reference tone pitch in the apparatus;

a process of shifting the frequency axis of said octave profile by the amount of said detected deviation;

a process of providing reference chord profiles respectively for a plurality of chord types, each chord profile exhibiting a pattern of frequency components existing at frequency zones each of a semitone span corresponding to chord constituent tones for said each chord type; and a process of comparing the pitch-adjusted octave profile with said reference chord profiles to find a reference chord profile that coincides with said pitch-adjusted octave profile, thereby determining the chord established by the incoming sound wave.

11. A machine readable medium according to claim 10, further containing program instructions executable by said computer for executing:

a process of taking the autocorrelation among the frequency components in said octave profile on the basic unit of a semitone span in order to enhance said peaks in the frequency spectrum of said octave profile on a semitone basis.

12. A machine readable medium according to claim 10, in which said process of detecting a deviation of the reference tone pitch includes:

a process of folding and superposing said octave profile on a semitone span basis to create a semitone profile exhibiting a folded frequency spectrum over a semitone span;

a process of ring-shifting said semitone profile by a predetermined pitch amount successively, one shift after another shift, to calculate a variance at each said shift; and a process of detecting the deviation amount of the reference tone pitch of said semitone profile from the reference tone pitch of the apparatus based on the shift amount that gives the minimum variance value among the calculated variances for the respective shifts.

13. A machine readable medium according to claim 12, in which said process of providing reference chord profiles is a process of providing each of said reference chord profiles in the form of weighting values for the respective frequency components existing in said frequency zones each of a semitone span; and in which said process of comparing the pitch-adjusted octave profile includes a process of multiplying the levels of the frequency components in said pitch-adjusted octave profile in each semitone span and said weighting values in each semitone span, the multiplication being conducted between each corresponding pair of frequency components in the respective semitone spans, and a process of summing up the multiplication results to determine the chord of said sound wave.

14. An apparatus for recognizing musical chords from incoming musical sound wave data representing a musical sound wave of a musical performance including musical tones based on a reference tone pitch of the musical performance, said apparatus comprising:

frequency component extracting means for extracting frequency components in the form of a frequency spectrum having peaks in level from said incoming musical sound wave data;

frequency range cutting out means for cutting out frequency component data included in a predetermined frequency range from said extracted frequency component data;

octave profile creating means for folding and superposing the cut-out frequency component data on the basis of the frequency width of an octave span to create an octave profile of the musical sound wave in the form of a frequency spectrum having peaks in level, said octave span being defined based on a reference tone pitch predetermined for the apparatus;

pitch deviation detecting means for detecting a deviation of the reference tone pitch of said incoming musical sound wave from the reference tone pitch in the apparatus;

pitch adjusting means for shifting the frequency axis of said octave profile by the amount of said detected deviation;

reference chord profile providing means for providing reference chord profiles respectively for a plurality of chord types, each chord profile exhibiting a pattern of frequency components existing at frequency zones each of a semitone span corresponding to chord constituent tones for said each chord type; and chord determining means for comparing the pitch-adjusted octave profile with said reference chord profiles to find a reference chord profile that coincides with said pitch-adjusted octave profile, thereby determining the chord established by the incoming sound wave.

* * * * *